US010938082B2

(12) United States Patent
Rogers

(10) Patent No.: US 10,938,082 B2
(45) Date of Patent: Mar. 2, 2021

(54) APERTURE-COUPLED MICROSTRIP-TO-WAVEGUIDE TRANSITIONS

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 96 days.

(21) Appl. No.: 16/111,830

(22) Filed: Aug. 24, 2018

(65) Prior Publication Data

US 2020/0067165 A1 Feb. 27, 2020

(51) Int. Cl.
*H01Q 9/04* (2006.01)
*H01Q 9/06* (2006.01)
(Continued)

(52) U.S. Cl.
CPC ..... *H01P 5/085* (2013.01); *H01P 3/08* (2013.01); *H01P 3/12* (2013.01); *H01P 11/002* (2013.01);
(Continued)

(58) Field of Classification Search
CPC .... H01Q 9/045; H01Q 21/065; H01Q 9/0414; H01Q 21/0075; H01Q 13/06;
(Continued)

(56) References Cited

U.S. PATENT DOCUMENTS 2,677,766 A 5/1954 Litchford
3,404,405 A 10/1968 Young
(Continued)

FOREIGN PATENT DOCUMENTS

CN 105846051 A 8/2016
EP 2573872 A1 3/2013
(Continued)

OTHER PUBLICATIONS

Grabherr, W. et al., "Microstrip to Waveguide Transition Compatible With mm-Wave Integrated Circuits," IEEE Transactions on Microwave Theory and Techniques, vol. 42, No. 9, Sep. 1994, pp. 1842-1843.

(Continued)

*Primary Examiner* — Hai V Tran
*Assistant Examiner* — Michael M Bouizza
(74) *Attorney, Agent, or Firm* — Moore IP Law

(57) ABSTRACT

An aperture coupled microstrip-to-waveguide transition ("ACMWT") is disclosed that includes a plurality of dielectric layers forming a dielectric structure and an inner conductor formed within the dielectric structure. The plurality of dielectric layers includes a top dielectric layer that has a top surface. The ("ACMWT") further includes a patch antenna element ("PAE") formed on the top surface, a bottom conductor, an antenna slot within the PAE, a coupling element ("CE") formed above the inner conductor and below the PAE, and a waveguide. The waveguide includes at least one waveguide wall and a waveguide backend, where the waveguide backend has a waveguide backend surface that's a portion of the top surface of the top dielectric layer and where the waveguide backend surface and the at least one waveguide wall form a waveguide cavity within the waveguide. The PAE is a conductor located within the waveguide cavity at the waveguide backend surface.

20 Claims, 26 Drawing Sheets

(51) Int. Cl.

| | |
|---|---|
| ***H01P 5/08*** | (2006.01) |
| ***H01P 3/08*** | (2006.01) |
| ***H01P 11/00*** | (2006.01) |
| ***H01P 3/12*** | (2006.01) |
| ***H01Q 21/06*** | (2006.01) |

(52) U.S. Cl.
CPC ..... *H01P 11/003* (2013.01); *H01Q 9/045* (2013.01); *H01Q 21/065* (2013.01)

(58) Field of Classification Search
CPC ..... H01P 5/085; H01P 3/12; H01P 11/003; H01P 11/002; H01P 3/08; H01P 5/107
See application file for complete search history.

(56) References Cited

U.S. PATENT DOCUMENTS

| | | | | |
|---|---|---|---|---|
| 3,665,480 | A | 5/1972 | Fassett | |
| 3,696,433 | A | 10/1972 | Killion et al. | |
| 3,729,740 | A | 4/1973 | Nakahara et al. | |
| 4,197,545 | A | 4/1980 | Favaloro et al. | |
| 4,232,321 | A | 11/1980 | Ohm | |
| 4,313,120 | A | 1/1982 | Westerman | |
| 4,835,538 | A | 5/1989 | McKenna et al. | |
| 4,862,185 | A | 8/1989 | Andrews et al. | |
| 5,043,738 | A | 8/1991 | Shapiro et al. | |
| 5,218,322 | A | 6/1993 | Allison et al. | |
| 5,353,035 | A | 10/1994 | Cuervo-Arango et al. | |
| 5,421,848 | A | 6/1995 | Maier et al. | |
| 5,473,336 | A | 12/1995 | Harman et al. | |
| 5,581,267 | A | 12/1996 | Matsui et al. | |
| 5,726,666 | A | 3/1998 | Hoover et al. | |
| 5,914,693 | A | 6/1999 | Takei et al. | |
| 5,977,710 | A | 11/1999 | Kuramoto et al. | |
| 5,977,924 | A | 11/1999 | Takei et al. | |
| 5,982,256 | A | 11/1999 | Uchimura et al. | |
| 6,005,520 | A | 12/1999 | Nalbandian et al. | |
| 6,198,453 | B1 | 3/2001 | Chew | |
| 6,252,549 | B1 | 6/2001 | Derneryd | |
| 6,285,325 | B1 | 9/2001 | Nalbandian et al. | |
| 6,593,887 | B2 | 7/2003 | Luk et al. | |
| 6,646,609 | B2 | 11/2003 | Yuasa et al. | |
| 6,664,931 | B1 | 12/2003 | Nguyen et al. | |
| 7,385,462 | B1 | 6/2008 | Epp et al. | |
| 7,471,248 | B2 | 12/2008 | Popugaev et al. | |
| 7,471,258 | B2 | 12/2008 | Hsu et al. | |
| 8,197,473 | B2 | 6/2012 | Rossetto et al. | |
| 8,384,499 | B2 | 2/2013 | Suzuki et al. | |
| 8,665,142 | B2 | 3/2014 | Shijo et al. | |
| 8,860,532 | B2 * | 10/2014 | Gong | H01P 1/208 333/202 |
| 9,437,184 | B1 | 9/2016 | Swett | |
| 9,496,613 | B2 | 11/2016 | Sawa | |
| 9,979,459 | B2 | 5/2018 | Savage et al. | |
| 10,283,832 | B1 * | 5/2019 | Chayat | H01Q 13/18 |
| 10,291,312 | B2 | 5/2019 | Savage et al. | |
| 10,522,916 | B2 | 12/2019 | Rogers et al. | |
| 10,777,905 | B2 | 9/2020 | Diehl et al. | |
| 2002/0047803 | A1 | 4/2002 | Ishitobi et al. | |
| 2003/0006941 | A1 | 1/2003 | Ebling et al. | |
| 2003/0043086 | A1 | 3/2003 | Schaffner et al. | |
| 2003/0103006 | A1 | 6/2003 | Yamada | |
| 2004/0104852 | A1 | 6/2004 | Choi et al. | |
| 2004/0196203 | A1 | 10/2004 | Lier et al. | |
| 2006/0001574 | A1 | 1/2006 | Petros | |
| 2006/0044188 | A1 | 3/2006 | Tsai et al. | |
| 2006/0098272 | A1 | 5/2006 | Lerner et al. | |
| 2007/0216596 | A1 | 9/2007 | Lewis et al. | |
| 2007/0279143 | A1 | 12/2007 | Itsuji | |
| 2008/0136553 | A1 | 6/2008 | Choi et al. | |
| 2008/0252544 | A1 | 10/2008 | Irion et al. | |
| 2009/0046029 | A1 | 2/2009 | Nagai | |
| 2009/0289858 | A1 | 11/2009 | Olsson | |
| 2010/0001916 | A1 | 1/2010 | Yamaguchi et al. | |
| 2010/0181379 | A1 | 7/2010 | Okegawa et al. | |
| 2010/0245155 | A1 | 9/2010 | Miyazato et al. | |
| 2011/0062234 | A1 | 3/2011 | Oishi | |
| 2011/0090129 | A1 | 4/2011 | Weily et al. | |
| 2011/0165839 | A1 | 7/2011 | Kawamura et al. | |
| 2012/0276856 | A1 | 11/2012 | Joshi et al. | |
| 2012/0287019 | A1 | 11/2012 | Sudo et al. | |
| 2012/0299783 | A1 | 11/2012 | Lee et al. | |
| 2013/0063310 | A1 | 3/2013 | Mak et al. | |
| 2013/0258490 | A1 | 10/2013 | Ishihara | |
| 2013/0278467 | A1 | 10/2013 | Dassano et al. | |
| 2014/0110841 | A1 | 4/2014 | Beer et al. | |
| 2014/0168014 | A1 | 6/2014 | Chih et al. | |
| 2014/0354411 | A1 | 12/2014 | Pudenz | |
| 2015/0249283 | A1 | 9/2015 | Watanabe et al. | |
| 2015/0364823 | A1 | 12/2015 | Hashimoto et al. | |
| 2016/0056541 | A1 * | 2/2016 | Tageman | H01Q 13/18 343/771 |
| 2016/0056544 | A1 | 2/2016 | Garcia et al. | |
| 2016/0126617 | A1 | 5/2016 | Jan et al. | |
| 2016/0126637 | A1 | 5/2016 | Uemichi | |
| 2016/0190696 | A1 | 6/2016 | Preradovic et al. | |
| 2016/0190697 | A1 | 6/2016 | Preradovic et al. | |
| 2016/0218420 | A1 | 7/2016 | Leung et al. | |
| 2016/0261036 | A1 | 9/2016 | Sato et al. | |
| 2016/0294045 | A1 | 10/2016 | Shiu et al. | |
| 2016/0295335 | A1 | 10/2016 | Vajha et al. | |
| 2016/0322703 | A1 | 11/2016 | Jesme et al. | |
| 2017/0084971 | A1 * | 3/2017 | Kildal | H01P 1/2005 |
| 2017/0133756 | A1 * | 5/2017 | Eastburg | H01Q 21/061 |
| 2019/0067805 | A1 | 2/2019 | Rogers et al. | |
| 2019/0086581 | A1 | 3/2019 | Diehl et al. | |
| 2019/0237844 | A1 | 8/2019 | Rogers et al. | |
| 2019/0237876 | A1 | 8/2019 | Rogers et al. | |
| 2020/0067165 | A1 | 2/2020 | Rogers | |
| 2020/0067201 | A1 | 2/2020 | Rogers | |

FOREIGN PATENT DOCUMENTS

| | | | |
|---|---|---|---|
| EP | 2750246 | A1 | 7/2014 |
| EP | 3012916 | A1 | 4/2016 |
| JP | 2003283239 | A | 10/2003 |
| KR | 100449846 | B1 | 9/2004 |
| WO | 20150102938 | | 7/2015 |

OTHER PUBLICATIONS

Iizuka, Hideo et al., "Millimeter-Wave Microstrip Line to Waveguide Transition Fabricated on a Single Layer Dielectric Substrate," R&D Review of Toyota CRDL, vol. 37, No. 2, Jun. 2002, pp. 13-18.

Iwasaki, H. "A circularly polarized small-size microstrip antenna with a cross slot," IEEE Transactions on Antennas and Propagation, Oct. 1996.

Kaneda, Noriaki et al., "A Broad-band Microstrip-to-Waveguide Transition Using Quasi-Yagi Antenna," IEEE Transactions on Microwave Theory and Techniques, Dec. 1999, pp. 1-4.

Li, B. et al., "Study on High Gain Circular Waveguide Array Antenna with Metamaterial Structure," Progress in Electromagnetics Research (PIER), vol. 6, 2006, pp. 207-219.

Lin, Ting-Huei et al., "CPW to Waveguide Transition with Tapered Slotline Probe," IEEE Microwave and Wireless Components Letters, vol. 11, No. 7, Jul. 2001, pp. 314-316.

Menzel, W. et al. "A microstrip patch antenna with coplanar feed line," IEEE Microwave and Guided Wave Letters, Nov. 1991.

Ponchak, George E et al., "A New Rectangular Waveguide to Coplanar Waveguide Transition," IEEE MTT-S International Microwave Symposium, May. 1990, 4 pgs.

Rida, Amin et al., "Proximity Coupled Fed Antenna Arrays on LCP for mm-Wave Applications," IEEE Antennas and Propagation Society International Symposium, Jul. 2010, 4 pgs.

Simon, W. et al., "A Novel Coplanar Transmission Line to Rectangular Waveguide Transition," IEEE MTT-S Digest, Jun. 1998, pp. 257-260.

Targonski, S.D. et al., "Design of wideband circularly polarized aperture-coupled microstrip antennas," IEEE Transactions on Antennas and Propagation, Feb. 1993.

(56) References Cited

OTHER PUBLICATIONS

Wang, C., et al., "A novel CP patch antenna with a single feed structure," IEEE Antennas and Propagation Society International Symposium, Jul. 2000.
Wang, J., et al., "Multifunctional aperture coupled stack patch antenna," Electronics Letters, Dec. 1990.
Zhang, Guo-Hua, et al. "A Circular Waveguide Antenna Using High-Impedance Ground Plane," IEEE Antennas and Wireless Propagation Letters, vol. 2, 2003, pp. 86-88.
Zurcher, J.F., "The SSFIP: a global concept for high-performance broadband patch antennas," Electronics Letters, Nov. 1988.
Abu Tarboush, H. F. et al., "Bandwidth Enhancement for Microstrip Patch Antenna Using Stacked Patch and Slot", 2009 IEEE International Workshop on Antenna Technology, Mar. 2-4, 2009, 4 pgs.
Allen, J. W., et al., "Design and fabrication of an RF GRIN lens 3D printing technology", Proc. of SPIE, vol. 8624, Feb. 20, 2013, 8 pgs.
Ambresh P. A., et al., "Effect of Slots on Microstrip Patch Antenna Characteristics", International Conference on Computer, Communication and Electrical Technology—ICCCET2011, Mar. 18 & 19, 2011, pgs. 239-241.
Cheng, Yu Jian, et al., "W-Band Large-Scale High-Gain Planar Integrated Antenna Array," IEEE Transactions on Antennas and Propagation, vol. 62, No. 6, Jun. 2014, pp. 3370-3373.
Cook, Benjamin S. et al. "Multilayer Inkjet Printing of Millimeter-Wave Proximity-Fed Patch Arrays on Flexible Substrates", IEEE Antennas and Wireless Propagation Letters, vol. 12, 2013, pp. 1351-1354.
Davidowitz, Marat et al., "Rigorous Analysis of a Circular Patch Antenna Excited by a Microstrip Transmission Line", IEEE Transactions on Antennas and Propagation, vol. 37, No. 8, Aug. 1989, pp. 949-958.
Delgado, Guillermo et al., "Scanning Properties of Teflon Lenses," Microwave and Optical Technology Letters, vol. 11, No. 5, Apr. 5, 1996, pp. 271-273.
European Patent Office Extended Search Report, Application No. 17175267.8-1927, dated Oct. 19, 2017.
Extended European Search Report for Application No. 18189791.9 dated Feb. 18, 2019, 8 pgs.
Gauthier, Gildas P. et al., "A 94-GHz Aperture-Coupled Micromachined Microstrip Antenna," IEEE Transactions on Antennas and Propagation, vol. 47, No. 12, Dec. 1999, pp. 1761-1766.
Iwaski, Hisao, "A Circularly Polarized Small-Size Microstrip Antenna with a Cross Slot", IEEE Transactions on Antennas and Propagation, vol. 44, No. 10, Oct. 1996, pp. 1399-1401.
Jackson, D.R., Caloz, C., et al., "Leaky-wave antennas," Proceedings of the IEEE, Jul. 2012.
Jain, Sidharath, et al., "Flat-Base Broadband Multibeam Luneburg Lens for Wide Angle Scan," Cornell University, May 4, 2013, arXiv.org > physics > arXiv:1305.0964.
Kim, D.H., Eom, H.J., "Radiation of a leaky coaxial cable with narrow traverse slots," IEEE Transactions on Antennas and Propagation, Jan. 2007, pp. 107-110.
Papapolymerou, Ioannis et al., "Micromachined Patch Antennas," IEEE Transactions on Antennas and Propagation, vol. 46, No. 2, Feb. 1998, pp. 275-283.
Pozar, D.M. et al., "Increasing the Bandwidth of a Microstrip Antenna by Proximity Coupling", Electronics Letters Apr. 9, 1987 vol. 23 No. 8, pp. 368-369.
Pozar, D.M., "Microstrip Antenna Aperture Coupled to a Microstripline", Electronics Letters Jan. 17, 1985 vol. 21 No. 2, pp. 49-50.
Pozar, David M. et al., "A Rigorous Analysis of a Microstripline Fed Patch Antenna", IEEE Transactions on Antennas and Propagation, vol. AP-35, No. 12, Dec. 1987, pp. 1343-1350.
Rida, Amin et al., "Proximity Coupled Fed Antenna Arrays on LCP with mm-Wave Applications," IEEE 2010, 4 pgs.
Satoshi, Y., Tahara, Y., et al., "Inclined slot array antennas on a rectangular coaxial line," Proceedings of the 5th European Conference on Antennas and Propagation, 2011.
Schoenlinner, Bernhard, "Compact Wide Scan-Angle Antennas for Automotive Applications and RF MEMS Switchable Frequency-Selective Surfaces," A dissertation submitted in partial fulfillment of the requirements for the degree of Doctor of Philosophy, The University of Michigan, 2004, 72 pgs.
Schoenlinner, Bernhard, "Wide-Scan Spherical-Lens Antennas for Automotive Radars," IEEE Transactions on Microwave theory and Techniquest, vol. 50, No. 9, Sep. 2002, pp. 2166-2175.
Sorkherizi, Milad S. et al., "Planar High-efficiency Antenna Array Using New Printed Ridge Gap Waveguide Technology," IEEE Transactions on Antennas and Propogation, vol. 65, No. 7, Jul. 2017, pp. 3772-3776.
Tribe, J. et al., "Additively manufactured hetrogeneous substrates for three-dimensional control of permittivity," Electronics Letters, May 8, 2014, vol. 50, No. 10, pp. 745-746.
Zhang, S. et al., "3D- printed flat lens for microwave applications," presented at the Antennas and Propagation Conference (LAPC2015) Loughborough University, 4 pgs.

* cited by examiner

APERTURE-COUPLED MICROSTRIP-TO-WAVEGUIDE TRANSITIONS

CROSS-REFERENCE TO RELATED APPLICATIONS

This application is related to U.S. patent application Ser. No. 16/111,778, entitled "CONFORMAL ANTENNA WITH ENHANCED CIRCULAR POLARIZATION," filed on Aug. 24, 2018 , to inventor John E. Rogers, and U.S. patent application Ser. No. 16/111,930 , entitled "WAVEGUIDE-FED PLANAR ANTENNA ARRAY WITH ENHANCED CIRCULAR POLARIZATION," filed on Aug. 24, 2018, to inventor John E. Rogers, both of which applications are incorporated by reference herein in their entireties.

BACKGROUND

1. Field

The present disclosure is related to waveguide transitions, and more specifically, to microstrip-to-waveguide transitions.

2. Related Art

At present, waveguides are used in many RF applications for low-loss signal propagation; however, they are generally not directly compatible with surface-mount device ("SMD") RF electronics. Known approaches are to utilize waveguide-to-coax adapters for first transitioning from a waveguide to the electronics-compatible coax cable and then utilizing a coax-to-RF board adapter. Unfortunately, existing waveguide-to-coax adapters do not mate well with RF boards because they are typically bulky devices that include waveguide tubing, flanges and a combination of a coaxial probe assembly with coaxial adapter and connection hardware to connect the coaxial adapter to the RF board. As such, at present, known waveguide-to-coax adapters have size, weight, and power ("SWaP") characteristics and costs that are not compatible with low-cost and conformal RF applications.

As such, there is a need for a new microstrip-to-waveguide transition that addresses one or more of these issues.

SUMMARY

Disclosed is an aperture coupled microstrip-to-waveguide transition ("ACMWT"). The ACMWT includes a plurality of dielectric layers forming a dielectric structure and an inner conductor formed within the dielectric structure. The plurality of dielectric layers includes a top dielectric layer that has a top surface. The ACMWT further includes a patch antenna element ("PAE") formed on the top surface, a bottom conductor, an antenna slot within the PAE, a coupling element ("CE") formed within the dielectric structure between the PAE and inner conductor, and a waveguide. The waveguide includes at least one waveguide wall and a waveguide backend, where the waveguide backend has a waveguide backend surface that is a portion of the top surface of the top dielectric layer and where the waveguide backend surface and the at least one waveguide wall form a waveguide cavity within the waveguide. The PAE is a conductor and is located within the waveguide cavity at the waveguide backend surface and the ACMWT is configured to support a transverse electromagnetic ("TEM") signal within the dielectric structure and a transverse electric ("TE") signal and a transverse magnetic ("TM") signal within the waveguide.

Also disclosed is a method for fabricating the ACMWT utilizing a lamination process. The method includes patterning a first conductive layer on a bottom surface of a first dielectric layer to produce a bottom conductor and patterning a second conductive layer on a top surface of a second dielectric layer to produce an inner conductor. The first dielectric layer includes a top surface and the second dielectric layer includes a bottom surface. The method then includes laminating the bottom surface of the second dielectric layer to the top surface of the first dielectric layer and patterning a third conductive layer on a top surface of a third dielectric layer to produce a PAE with an antenna slot. The third dielectric layer includes a bottom surface. The method then includes patterning a fourth conductive layer on a top surface of a fourth dielectric layer to produce a CE, where the fourth dielectric layer includes a bottom surface, laminating the bottom surface of the fourth dielectric layer to the top surface of the second dielectric layer to produce a second combination, and laminating the bottom surface of the third dielectric layer to the top surface of the fourth dielectric layer to produce a composite laminated structure. The composite laminated structure is a dielectric structure. The method then includes attaching a waveguide wall to the composite laminated structure.

Further disclosed is a method for fabricating the ACMWT utilizing a three-dimensional ("3-D") additive printing process. The method includes printing a first conductive layer having a top surface and a first width. The first width has a first center and the first conductive layer is a bottom layer configured as a reference ground plane. The method then includes printing a first dielectric layer on the top surface of the first conductive layer, where the first dielectric layer has a top surface, printing a second dielectric layer on the top surface of the first dielectric layer, where the second dielectric layer has a top surface, and printing a second conductive layer on the top surface of the second dielectric layer. The second conductive layer has a top surface and a second width, the second width is less than the first width, and the second conductive layer is an inner conductor. The method then includes printing a third dielectric layer on the top surface of the second conductive layer and on the top surface on the second dielectric layer, where the third dielectric layer has a top surface, and printing a third conductive layer on the top surface of the fourth third dielectric layer. The third conductive layer has a top surface and a third width, the third width is less than the first width, and the third conductive layer is a CE. The method then includes printing a fourth dielectric layer on the top surface of the third conductive layer and on the top surface of the third dielectric layer, where the fourth dielectric layer has a top surface, and printing a fourth conductive layer on the top surface of the fourth dielectric layer to produce a PAE with an antenna slot. The fourth conductive layer has a fourth width, the fourth width is less than the first width, and the fourth conductive layer includes the antenna slot within the fourth conductive layer that exposes the top surface of the fourth dielectric layer through the fourth conductive layer. The method then includes attaching the waveguide wall to the fourth dielectric layer.

Other devices, apparatuses, systems, methods, features, and advantages of the invention will be or will become apparent to one with skill in the art upon examination of the following figures and detailed description. It is intended that all such additional devices, apparatuses, systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
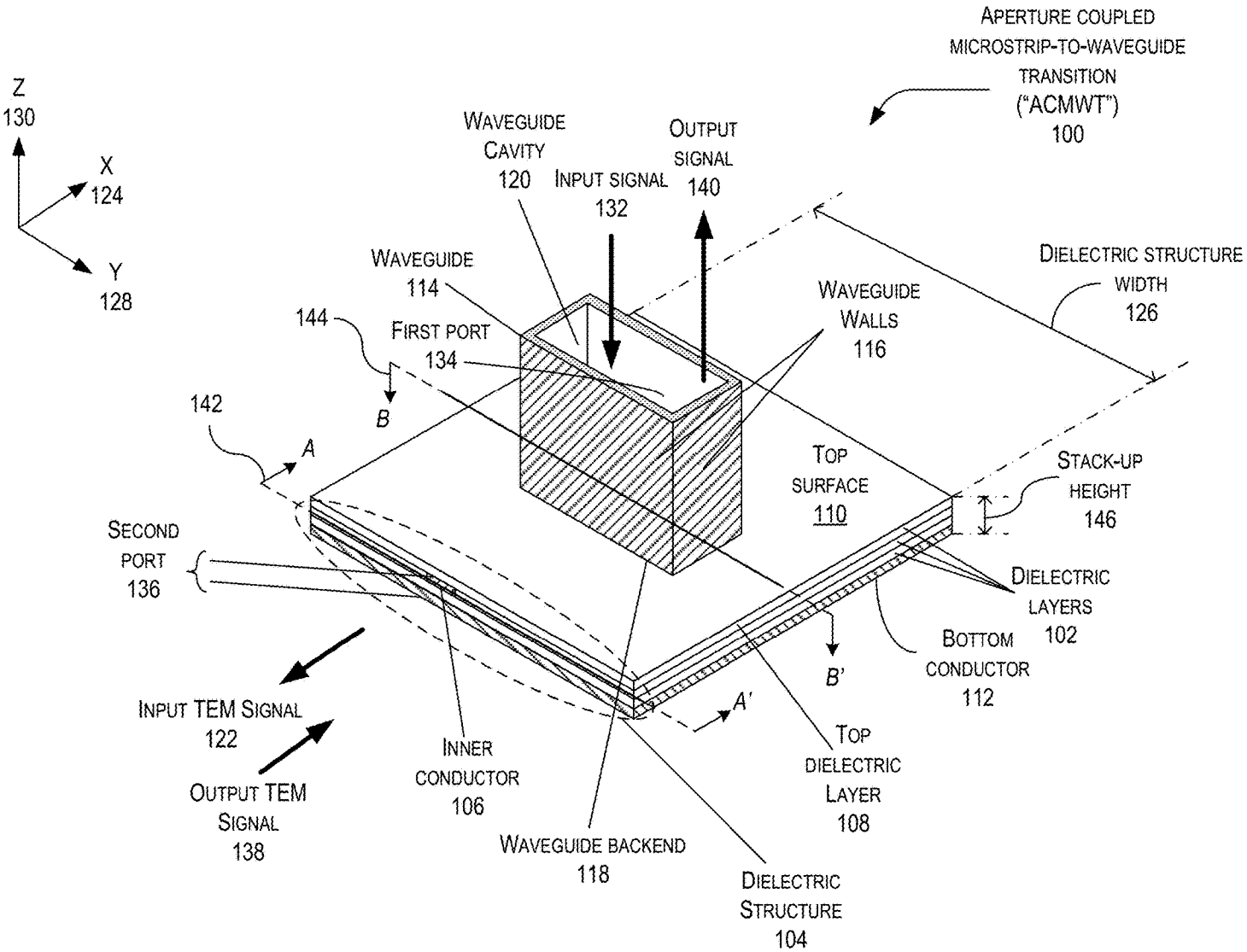
FIG. 1 is a perspective cross-sectional view of an example of an implementation of an aperture coupled microstrip-to-waveguide transition ("ACMWT") in accordance with the present disclosure.

An aperture coupled microstrip-to-waveguide transition ("ACMWT") is disclosed. The ACMWT includes a plurality of dielectric layers forming a dielectric structure and an inner conductor formed within the dielectric structure. The plurality of dielectric layers includes a top dielectric layer that has a top surface. The ACMWT further includes a patch antenna element ("PAE") formed on the top surface, a bottom conductor, an antenna slot within the PAE, a coupling element ("CE") formed within the dielectric structure between the PAE and inner conductor, and a waveguide. The waveguide includes at least one waveguide wall and a waveguide backend, where the waveguide backend has a waveguide backend surface that is a portion of the top surface of the top dielectric layer and where the waveguide backend surface and the at least one waveguide wall form a waveguide cavity within the waveguide. The PAE is a conductor and is located within the waveguide cavity at the waveguide backend surface and the ACMWT is configured to support a transverse electromagnetic ("TEM") signal within the dielectric structure and a transverse electric ("TE") signal and a transverse magnetic ("TM") signal within the waveguide.

Also disclosed is a method for fabricating the ACMWT utilizing a lamination process. The method includes patterning a first conductive layer on a bottom surface of a first dielectric layer to produce a bottom conductor and patterning a second conductive layer on a top surface of a second dielectric layer to produce an inner conductor. The first dielectric layer includes a top surface and the second dielectric layer includes a bottom surface. The method then includes laminating the bottom surface of the second dielectric layer to the top surface of the first dielectric layer and patterning a third conductive layer on a top surface of a third dielectric layer to produce a PAE with an antenna slot. The third dielectric layer includes a bottom surface. The method then includes patterning a fourth conductive layer on a top surface of a fourth dielectric layer to produce a CE, where the fourth dielectric layer includes a bottom surface, laminating the bottom surface of the fourth dielectric layer to the top surface of the second dielectric layer to produce a second combination, and laminating the bottom surface of the third dielectric layer to the top surface of the fourth dielectric layer to produce a composite laminated structure. The composite laminated structure is a dielectric structure. The method then includes attaching a waveguide wall to the composite laminated structure.

Further disclosed is a method for fabricating the ACMWT utilizing a three-dimensional ("3-D") additive printing process. The method includes printing a first conductive layer having a top surface and a first width. The first width has a first center and the first conductive layer is a bottom layer configured as a reference ground plane. The method then includes printing a first dielectric layer on the top surface of the first conductive layer, where the first dielectric layer has a top surface, printing a second dielectric layer on the top surface of the first dielectric layer, where the second dielectric layer has a top surface, and printing a second conductive layer on the top surface of the second dielectric layer. The second conductive layer has a top surface and a second width, the second width is less than the first width, and the second conductive layer is an inner conductor. The method then includes printing a third dielectric layer on the top surface of the second conductive layer and on the top surface on the second dielectric layer, where the third dielectric layer has a top surface, and printing a third conductive layer on the top surface of the fourth third dielectric layer. The third conductive layer has a top surface and a third width, the third width is less than the first width, and the third conductive layer is a CE. The method then includes printing a fourth dielectric layer on the top surface of the third conductive layer and on the top surface of the third dielectric layer, where the fourth dielectric layer has a top surface, and printing a fourth conductive layer on the top surface of the fourth dielectric layer to produce a PAE with an antenna slot. The fourth conductive layer has a fourth width, the fourth width is less than the first width, and the fourth conductive layer includes the antenna slot within the fourth conductive layer that exposes the top surface of the fourth dielectric layer through the fourth conductive layer. The method then includes attaching the waveguide wall to the fourth dielectric layer.

More specifically, in FIG. 1, a perspective cross-sectional view of an example of an implementation of the ACMWT 100 is shown in accordance with the present disclosure. The ACMWT 100 includes a plurality of dielectric layers 102 forming a dielectric structure 104 and an inner conductor 106 formed within the dielectric structure 104. The plurality of dielectric layers 102 includes a top dielectric layer 108 that has a top surface 110. The ACMWT 100 further includes a PAE (not shown) formed on the top surface 110, a bottom conductor 112, an antenna slot (not shown) within the PAE, an optional CE (not shown) formed within the dielectric structure 104, and a waveguide 114. The waveguide 114 includes at least one waveguide wall 116 and a waveguide backend 118, where the waveguide backend 118 has a waveguide backend surface (not shown) that is a portion of the top surface 110 of the top dielectric layer 108 and where the waveguide backend surface and the at least one waveguide wall 116 form a waveguide cavity 120 within the waveguide 114. The PAE is a conductor and is located within the waveguide cavity 120 at the waveguide backend surface and the ACMWT 100 is configured to support an input TEM signal 122 within the dielectric structure 104.

In this example, the inner conductor 106 extends along a length of the along an X-axis 124 to a position located below the PAE within the waveguide 114. The dielectric structure 104 has a dielectric structure width 126 along a Y-axis 128 and the waveguide 114 extends outward from the waveguide backend 118 at the top surface 110 of the top dielectric layer 108 in direction along a Z-axis 130.

Furthermore, in this example, the ACMWT 100 may also include CE (not shown), at least one cavity (not shown), or both. The inner conductor 106, CE, and the optional at least one cavity are formed within the dielectric structure 104, the PAE is formed on the waveguide backend surface, and the antenna slot is formed within the PAE. Moreover, the bottom conductor 112 is a conductor and is located below the dielectric structure 104 and the PAE is also a conductor. The antenna slot 204 is angled cut along the PAE and is angled with respect to the inner conductor 106. The antenna slot allows the top surface 110 to be exposed through the PAE. As such, the waveguide 114 is in signal communication with the inner conductor 106.

The inner conductor 106 is either a radio frequency ("RF") microstrip or stripline and the inner conductor 106, bottom conductor 112, PAE, CE, and at least one waveguide wall 116 may be metal conductors. The bottom conductor 112 acts as a lower reference ground plane that may be, for example, constructed of electroplated copper, while the inner conductor 106, PAE, and optional CE may also be constructed of electroplated copper or printed silver ink. Additionally, the at least one waveguide wall 116 may be constructed of aluminum.

In an example of operation, the ACMWT 100 is configured to receive an input signal 132 that is transmitted through the waveguide 114 along the negative direction of the Z-axis 130 and, in response, produce the input TEM signal 122 that is transmitted along the inner conductor 106 along the negative direction of the X-axis 124. Specifically, the input signal 132 propagates along a length of the waveguide 114 towards the waveguide backend surface (that is part of the top surface 110) where the combined PAE and angled antenna slot (herein antenna slot) are located. Once the input signal 132 reaches the combined PAE and antenna slot, electromagnetic coupling occurs between the combination of the PAE with the antenna slot, optional CE, and the inner conductor 106 to produce the Input TEM signal 122 that is propagated along the inner conductor 106.

In this example, it is appreciated by those of ordinary skill in the art that the electromagnetic characteristics of the input TEM signal 122 are determined by the geometry (or shape), dimensions (e.g., radius, thickness), and position of the PAE along the top surface 110, the geometry and dimensions (e.g., slot length and slot width) of the antenna slot within the PAE, the position of inner conductor in relation to the position of the PAE, the geometry and dimensions (e.g., length and width) of the CE, and the position of the optional CE with regards to the position of the PAE and the position of the inner conductor 106.

It is also appreciated by those of ordinary skill in the art that the ACMWT 100 is a reciprocal device because it is a passive device that only contains isotropic materials. In this example, the ACMWT 100 includes a first port 134 at an opening of the waveguide cavity 120 that allows TE signals and TM signals to propagate along the waveguide. The ACMWT 100 further includes a second port 136 within the dielectric structure 104 that allows TEM signals to propagate between the inner conductor 106 and bottom conductor 112. As such, the transmission of a signal between the two ports 134 and 136 does not depend on the direction of propagation of the signal. Specifically, as described earlier, an input signal 132 injected into the first port 134 at the waveguide 114 produces the input TEM signal 122 at the second port 136. Similarly, an output TEM signal 138 injected into the second port 136 produces the output signal 140 at the first port 134.

In this example, the inner conductor 106 is located within or on a middle dielectric layer (not shown) and the optional CE is located between the inner conductor 106 and the combination of the PAE with the antenna slot within a dielectric layer below the top dielectric layer 108 and above the middle dielectric layer. Based on the fabrication method utilized in producing the ACMWT 100, it will be shown in this disclosure that the middle dielectric layer may be a dielectric layer from the plurality of dielectric layers 102 or a dielectric layer formed from an adhesive layer of the plurality of adhesive layers, or combination of both.

In this example, a first cutting plane A-A' 142 and a second cutting plane B-B' 144 are shown looking into the ACMWT 100 at different angles. The first cutting plane A-A' 142 cuts through the dielectric structure 104 at a location approximately equal to half of a stack-up height 146 (i.e., at approximately the location of the inner conductor 106) and looking into a direction along the X-axis 124. The second cutting plane B-B' 144 cuts through the dielectric structure 104 at an approximate half-point of the location of the waveguide 114 along the top surface 110 of the top dielectric layer 108 and looking into a negative direction along the Z-axis 130.

It is appreciated by those of ordinary skill in the art that the circuits, components, modules, and/or devices of, or associated with, the ACMWT 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

In this example, the dielectric structure 104 may be constructed utilizing a lamination process in accordance with the present disclosure. This lamination process includes utilizing a plurality of adhesive films (also referred to as adhesive film layers or adhesive layers), or other similar type of dielectric adhesive material, to bond the dielectric layers 102 together to form the dielectric structure 104 with a lamination process that will be described later within this disclosure.

In this example, each dielectric layer, of the plurality of dielectric layers 102, may be an RF dielectric material and the inner conductor 106 may be a RF microstrip conductor or stripline conductor. Furthermore, in this example, if the optional CE is present, the plurality of dielectric layers 102 may include four (4) dielectric layers and the plurality of adhesive layers may include three (3) adhesive layers; however, this may vary based on the design of the ACMWT 100. It is appreciated that in this example, each of the three adhesive layers act as a dielectric with different dielectric properties than the other dielectric layers in plurality of dielectric layers 102.

The CE may be a conductive element such as a notch that extends outward from the inner conductor 106. The inner conductor 106 may be located at a predetermined center position within the dielectric structure 104. In this example, the center position is equal to approximately half of the stack-up height 146 along the Z-axis 130. Moreover, the inner conductor 106 may also have an inner conductor center that is located at a second position within the dielectric structure 104 that is approximately at a second center position that is equal to approximately half of the dielectric structure width 126. Furthermore, as will be shown later within this disclosure, the CE may be an approximately rectangular like conductive strip that is located below a combination of the PAE and slot antenna and top dielectric layer 108, and above the inner conductor 106. The length of the CE may extend outward from a width of the inner conductor 106 at a predetermined angle. As an example, the dielectric laminate material may be constructed of Pyralux® flexible circuit materials produced by E. I. du Pont de Nemours and Company of Wilmington, Del.

Alternatively, the dielectric structure 104 may be constructed utilizing a three-dimensional ("3-D") additive printing process. In this example, each dielectric layer (of the dielectric structure 104) may be constructed by printing (or "patterning"), which includes successively printing dielectric layers with dielectric ink and printing conductive layers with conductive ink. In these examples, each dielectric layer (of the dielectric structure 104) may have a thickness that is approximately equal 10 mils. The bottom conductor 112, inner conductor 106, optional CE, and PAE may have a thickness that is, for example, approximately equal to 0.7 mils (i.e., about 18 micrometers). For purposes of illustration, in this example, the dielectric structure 104 may include four (4) dielectric layers; again, this may vary based on the design of the ACMWT 100. In this example, there would not be any adhesive layers present since this process utilizes 3-D printing instead of lamination for producing the dielectric structure.

While not shown, based on the design of the ACMWT 100, an optional rigid surface layer may be placed on the top surface 110 that covers the top dielectric layer 108 and is physically attached to the waveguide 114 at or near the waveguide backend 118. If present, the optional rigid surface layer adds physical strength and rigidity to the waveguide 114 allowing it to interface with an external waveguide (not shown) without causing physical damage to the ACMWT 100. As an example, the optional rigid surface layer may be thick enough to incorporate the waveguide 114 within the optional rigid surface layer and may include screw holes around an opening of waveguide cavity 120 to attach the waveguide 114 and optional rigid surface layer to a flange of an external waveguide (not shown). Based on the design of the optional rigid surface layer, the optional rigid surface layer may be constructed of metal, plastics, or other rigid materials.

Figure 2:
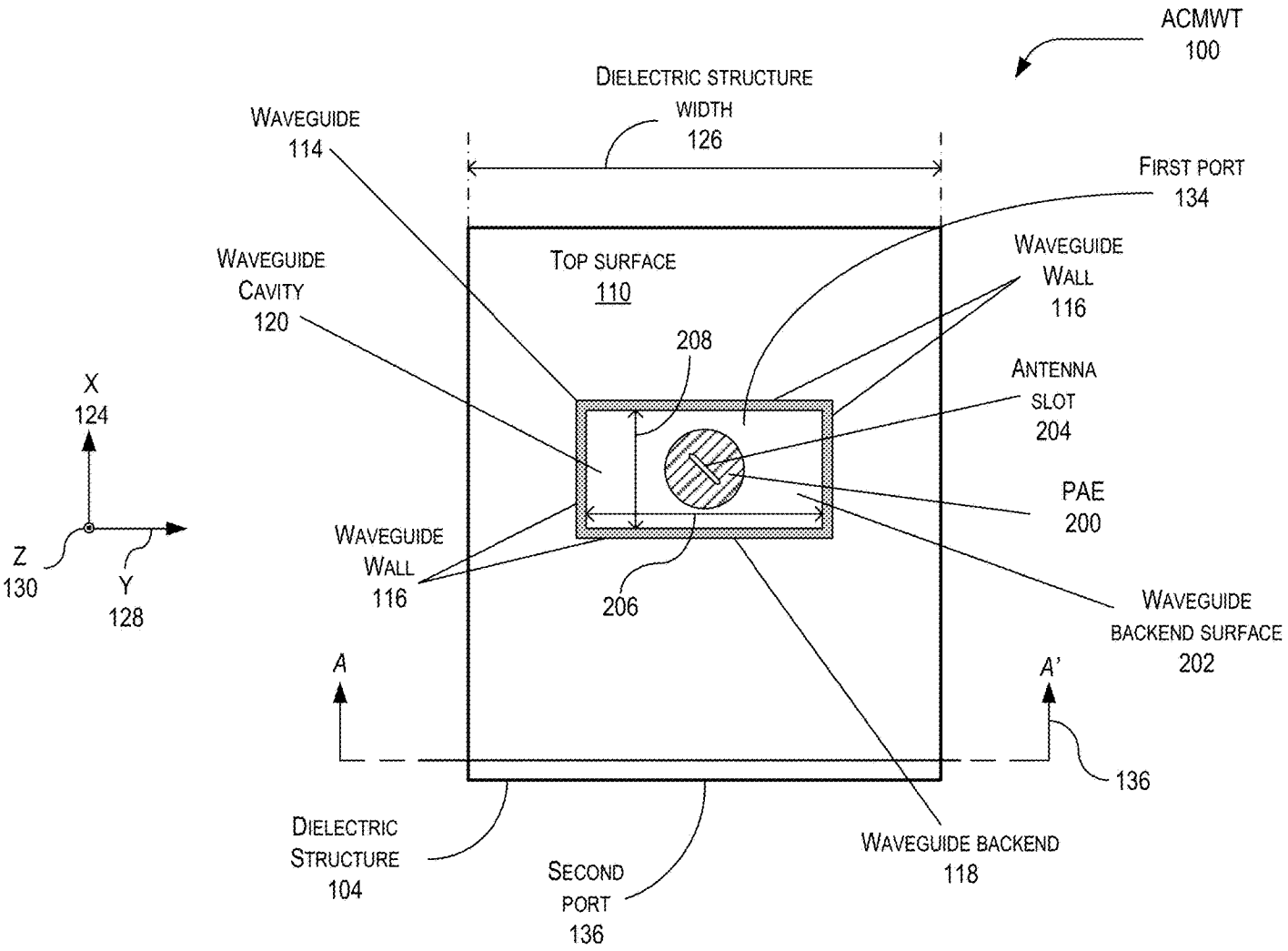
FIG. 2 is a top view of the ACMWT in accordance with the present disclosure.

In FIG. 2, a top view of the ACMWT 100 is shown in accordance with the present disclosure. In this view, the PAE 200 is shown located on the waveguide backend surface 202 within the waveguide cavity 120 of the waveguide 114. As discussed earlier, the waveguide backend surface 202 is part of the top surface 110 that is located within the waveguide cavity 120. The antenna slot 204 is shown cut along and through the PAE 200. In this example, the waveguide 114 is shown to be a rectangular waveguide having a waveguide width 206 and waveguide height 208 that is based on the design of the ACMWT 100.

Figure 3:
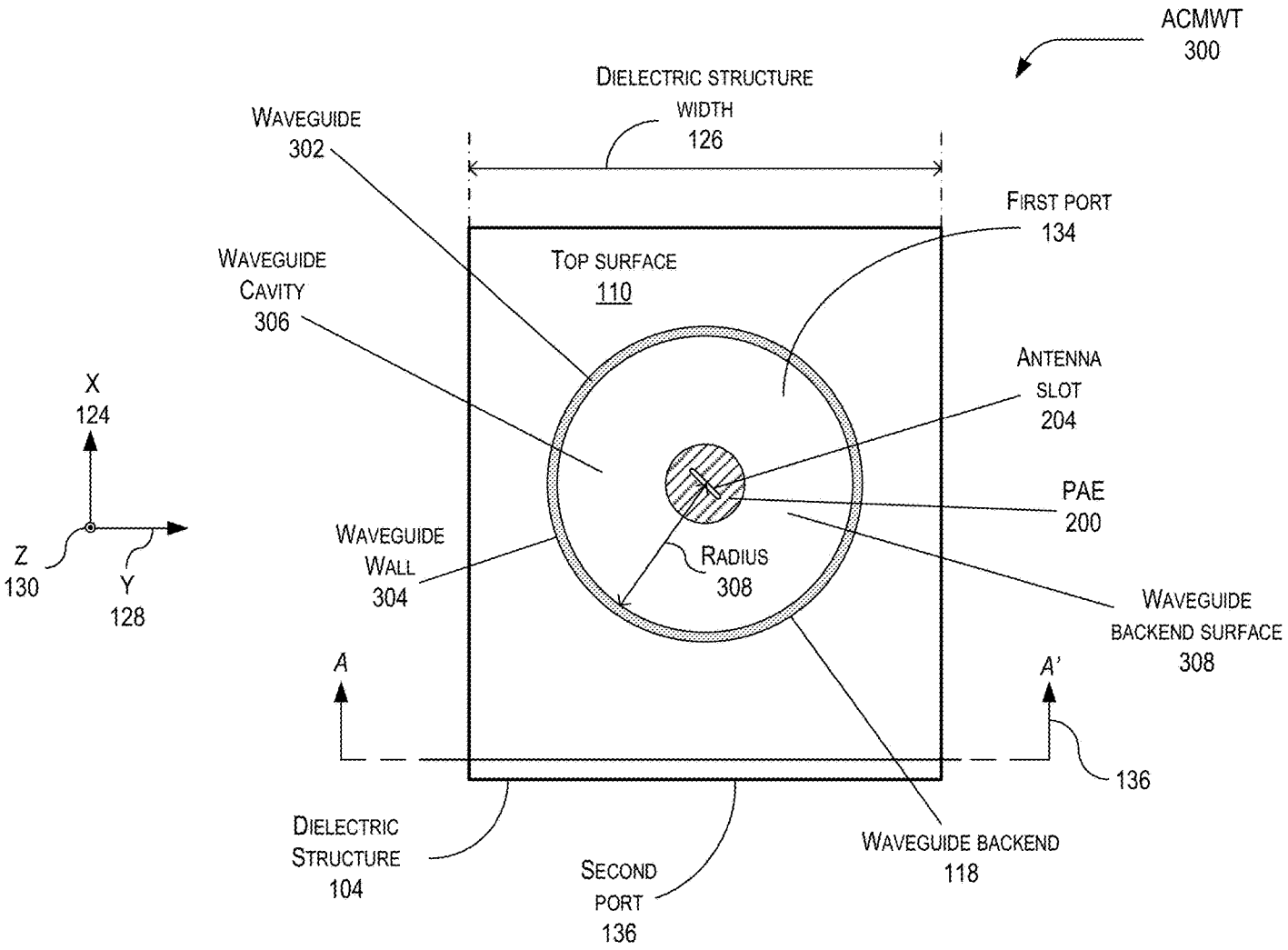
FIG. 3 is a top view of an example of another implementation of the ACMWT in accordance with the present disclosure.

In FIG. 3, a top view of an example of another implementation of the ACMWT 300 is shown in accordance with the present disclosure. This example, the ACMWT 300 has an elliptical waveguide 302 instead of a rectangular waveguide 114. The elliptical waveguide 302 only has a single waveguide wall 304 that defines the waveguide cavity 306, which defines the waveguide backend surface 308 along the top surface 110 of the top dielectric layer 108. The combination of the PAE 200 and antenna slot 204 are still located on the waveguide backend surface 308 within the waveguide cavity 306 at the waveguide backend 118 of the waveguide 302 on the top surface 110 of the top dielectric layer 108. The elliptical waveguide 302 may be a circular waveguide has a radius 309 that is based on the design of the ACMWT 300.

It is appreciated by those of ordinary skill in the art that the waveguide (either rectangular waveguide 114 or elliptical waveguide 302) is a hollow metallic waveguide filled with a homogeneous and isotropic material (usually air). As a result, the waveguide will support TE modes and TM modes of operation, but not a TEM mode as supported by the combination of the dielectric structure 104, inner conductor 106, and bottom conductor 112 that forms a microstrip signal path that is an electrical transmission line having a conductive strip (i.e., inner conductor 106) separated from a reference ground plane (i.e., bottom conductor 112) by a dielectric layer (i.e., at least a bottom dielectric layer) generally known as a substrate.

Figure 4:
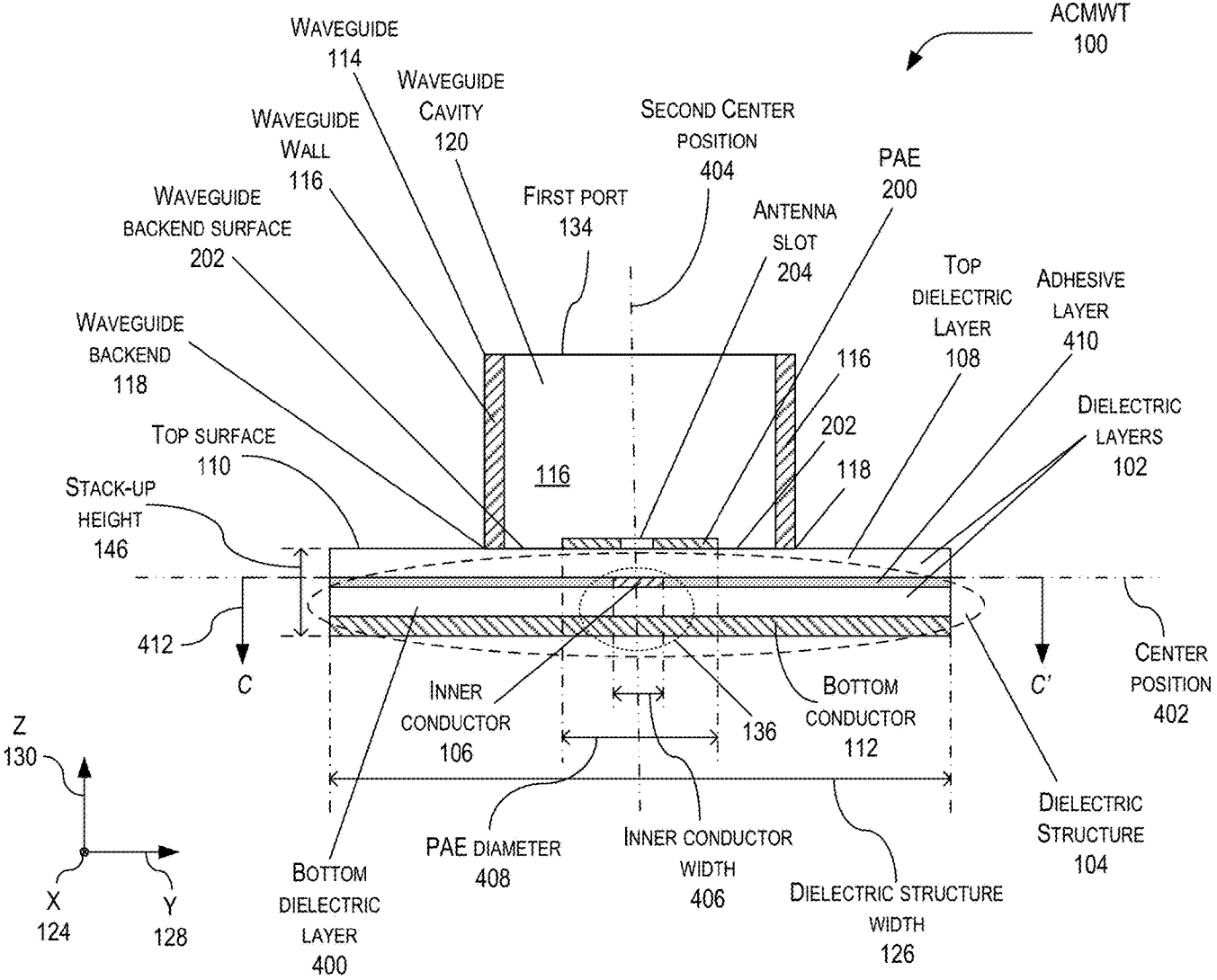
FIG. 4 is a cross-sectional front-view of an example of an implementation of the ACMWT (shown in FIG. 1) in accordance with the present disclosure.

In FIG. 4, a cross-sectional front-view of the ACMWT 100 is shown in accordance with the present disclosure. In this view, the dielectric structure 104, plurality of dielectric layers 102, top dielectric layer 108, bottom dielectric layer 400, stack-up height 146, inner conductor 106, top surface 110, bottom conductor 112, waveguide 114, waveguide wall 116, waveguide cavity 120, waveguide backend 118, waveguide backend surface 202, PAE 200, and antenna slot 204 are shown. In this example, each of the dielectric layers of the plurality of dielectric layers 102 are RF dielectrics.

In this example, the ACMWT 100 is shown to have a center position 402 that may be located at approximately half of the stack-up height 146 and a second center position 404 that is located at approximately half of the dielectric structure width 126. It is appreciated by those of ordinary skill in the art that while only two (2) dielectric layers are shown in the plurality of dielectric layers 102, any number greater than two may be utilized for the number of dielectric layers of the plurality of dielectric layers 102. The inner conductor 106 is also shown to have an inner conductor width 406 that is approximately centered about the second center position 404. The PAE 200 has a PAE diameter 408 that is wider than the inner conductor width 406.

In this example, the inner conductor 106 is an RF microstrip or stripline located below the PAE 200 with the antenna slot 204 acting as an aperture coupled antenna feed configured to couple energy to the PAE 200. In general, the inner conductor width 406 and its respective position below (i.e., the center position 402) the PAE 200 is predetermined by the design of the ACMWT 100 to approximately match the impedance between the inner conductor 106 and the PAE 200 with the antenna slot 204.

As such, while the center position 402 is shown in FIG. 4 to be approximately in the center of the stack-up height 146, it is appreciated by those of ordinary skill in the art that this is an approximation that may vary because the actual center position 402 may be predetermined from the design of the ACMWT 100. However, for purposes of illustration, the predetermined position is assumed to be generally close to the center position 402 of the stack-up height 146 but it is appreciated that this may vary based on the actual design of the ACMWT 100. Additionally, while not shown in this view, the antenna slot 204 within the PAE 200 increases the bandwidth of the PAE 200 and also has a predetermined angle along the PAE 200 with respect to the inner conductor 106 to provide circular polarization from the PAE 200 and a predetermined slot width to match the impedance between the inner conductor 106 and the PAE 200. In general, the bandwidth of the PAE 200 is enhanced by utilizing the aperture coupled feed line from the inner conductor 106 through antenna slot 200 as compared to coupling the inner conductor 106 to the PAE 200 without the presence of the antenna slot 204.

In this example, the top dielectric layer 108 and bottom dielectric layer 400 are laminated together with an adhesive layer 410 that may be an adhesive film, or other similar type of dielectric adhesive material, to bond the top dielectric layer 108 and bottom dielectric layer 400 together to form the dielectric structure 104 with a lamination process that will be described later within this disclosure. It is appreciated that in this example, that the adhesive layer 410 acts as a dielectric with different dielectric properties than the other dielectric layers in plurality of dielectric layers 102 (i.e., top dielectric layer 108 and bottom dielectric layer 400).

Alternatively, the dielectric structure 104 may be constructed utilizing a 3-D additive printing process. In this example, each dielectric layer (e.g., top dielectric layer 108 and bottom dielectric layer 400 of the dielectric structure 104) may be constructed by printing (or "patterning"), which includes successively printing dielectric layers with dielectric ink and printing conductive layers with conductive ink. In these examples, each dielectric layer (of the dielectric structure 104) may have a thickness that is approximately equal 10 mils. The bottom conductor 112, inner conductor 106, and PAE 200 may have a thickness that is, for example, approximately equal to 0.7 mils (i.e., about 18 micrometers). In this example, there would not be any adhesive layers (e.g., adhesive layer 410) present since this process utilizes 3-D printing instead of lamination for producing the dielectric structure 104.

In this example, a third cutting plane C-C' 412 is shown cutting through dielectric structure 104 at the inner conductor 106 and looking into the ACMWT 100. In this view, the antenna slot 204 is only partially visible because it is located within the PAE 200 that is therefore partially blocked by other parts of the PAE 200 shown in this view.

As discussed earlier, in an example of operation, in one direction, the input signal 132 travels through the waveguide 114 in a direction along the negative Z-axis 130 until it reaches the combination of the PAE 200 and antenna slot 204 on the waveguide backend surface 202 at the waveguide backend 118. Once the input signal 132 reaches the combination of the PAE 200 and antenna slot 204, the resulting electromagnetic field at the combination of the PAE 200 and antenna slot 204 couples to the inner conductor 106 producing the input TEM signal 122 that travels along the inner conductor 106 and bottom conductor 112 in a direction along the negative X-axis 124. In the other direction, the ACMWT 100 is also configured to receive the output TEM signal 138, at the second port 136, that is transmitted by the combination of the inner conductor 106 and bottom conductor 112 along the direction of the X-axis 124 and, in response, produces the output signal 140 that is transmitted along the waveguide 114, at the first port 134, along the direction of the Z-axis 130. In this example, it is appreciated that the waveguide shown in FIG. 4 may be either the rectangular waveguide 114 or the elliptical waveguide 302.

As discussed earlier, the ACMWT 100 may include an optional rigid surface layer that is located on top of the top surface 110 that covers the top dielectric layer 108 and is physically attached to the waveguide 114 at or near the waveguide backend 118. The optional rigid surface layer adds physical strength and rigidity to the waveguide 114 and allows it to interface with an external waveguide (not shown) without causing physically damage to the ACMWT 100. The optional rigid surface layer may have a thickness that is approximately equal to the height of the waveguide 114 so as to incorporate the waveguide 114 within the optional rigid surface layer and may include screw holes (not shown) around an opening of waveguide cavity 120 to attach the waveguide 114 and optional rigid surface layer to a flange of an external waveguide (not shown). Again, based on the design of the optional rigid surface layer, the optional rigid surface layer may be constructed of metal, plastics, or other rigid materials.

Figure 5:
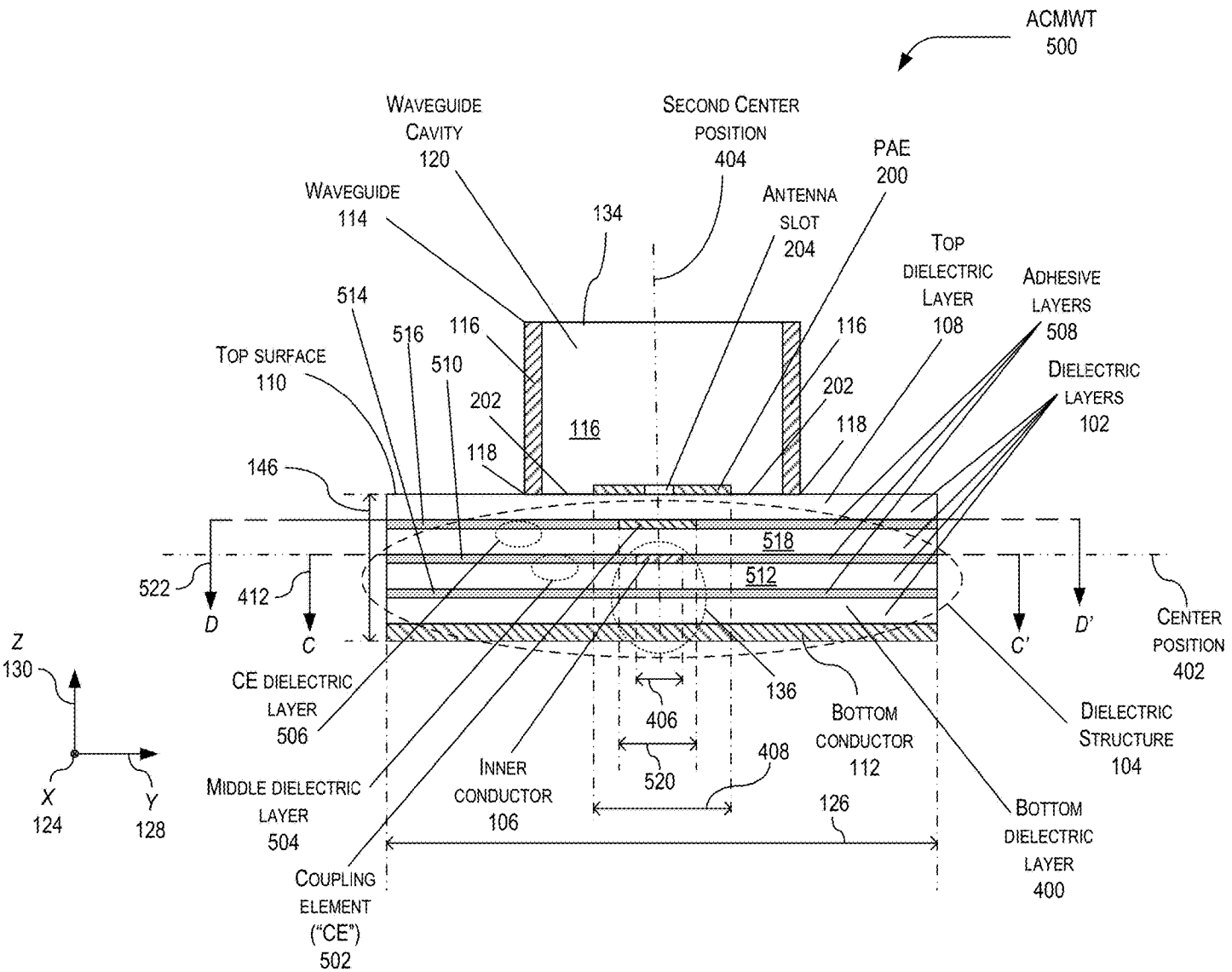
FIG. 5 is a cross-sectional front-view of an example of another implementation of the ACMWT (shown in FIG. 1) in accordance with the present disclosure.

In FIG. 5, a cross-sectional front-view of an example of another implementation of the ACMWT 500 is shown in accordance with the present disclosure. In this example, the ACMWT 500 includes a CE 502. The inner conductor 106 is located within or on a middle dielectric layer 504 and the CE 502 is located between the inner conductor 106 and the combination of the PAE 200 with the antenna slot 204 within or on a CE dielectric layer 506 below the top dielectric layer 108 and above the middle dielectric layer 504. Based on the fabrication method utilized in producing the ACMWT 500, the middle dielectric layer 504 may be a dielectric layer from the plurality of dielectric layers 102 or a dielectric layer formed from an adhesive layer of a plurality of adhesive layers 508, or a combination of both. Specifically, in the example shown in FIG. 5, the inner conductor 106 is shown as being located with an adhesive layer 510 (of the plurality of adhesive layers 508) on top of a dielectric layer 512. The dielectric layer 512 is on top of the combination of the bottom dielectric layer 400 and another adhesive layer 514 from the plurality of adhesive layers 508. In this example, assuming that the inner conductor 106 is exclusively located within the adhesive layer 510 and on top of the dielectric layer 512, the middle dielectric layer 504 would correspond to the adhesive layer 510. If, instead, the inner conductor 106 were exclusively located within the dielectric layer 512, the middle dielectric layer 504 would correspond to the dielectric layer 512. Alternatively, if the inner conductor 106 were located partially with the adhesive layer 510 and the dielectric layer 512, the middle dielectric layer 504 would correspond to a combination of the adhesive layer 510 and dielectric layer 512.

Similarly, based on the fabrication method utilized in producing the ACMWT 500, the CE dielectric layer 506 may be a dielectric layer from the plurality of dielectric layers 102 or a dielectric layer formed from an adhesive layer of a plurality of adhesive layers 508, or a combination of both. Specifically, in the example shown in FIG. 5, the CE 502 is shown as being located with an adhesive layer 516 (of the plurality of adhesive layers 508) on top of a dielectric layer 518. The dielectric layer 518 is on top of the combination of the dielectric layer 512 and adhesive layer 510. In this example, assuming that the CE 502 is exclusively located within the adhesive layer 516 and on top of the dielectric layer 518, the CE dielectric layer 506 would correspond to the adhesive layer 516. If, instead, the CE 502 were exclusively located within the dielectric layer 518, the CE dielectric layer 506 would correspond to the dielectric layer 518. Alternatively, if the CE 502 were located partially with the adhesive layer 516 and the dielectric layer 518, the CE dielectric layer 506 would correspond to a combination of the adhesive layer 516 and dielectric layer 518.

As discussed earlier, in this example, each dielectric layer, of the plurality of dielectric layers 102, may be an RF dielectric material and the inner conductor 106 may be a RF microstrip conductor or stripline conductor. Unlike the previous example, in this example, the plurality of dielectric layers 102 may include four (4) dielectric layers and the plurality of adhesive layers 508 may include three (3) adhesive layers; however, this may vary based on the design of the ACMWT 500. It is appreciated that in this example, each of the three adhesive layers 508 act as a dielectric with different dielectric properties than the other dielectric layers in plurality of dielectric layers 102.

The CE 502 may be a conductive element such as a notch that extends outward from the inner conductor 106. The inner conductor 106 may be located at a predetermined center position within the dielectric structure 104 (e.g., at the center position 402 and second center position 404). Again, in this example, the center position 402 is equal to approximately half of a stack-up height 146 along a Z-axis 130. Moreover, the inner conductor 106 may also have an inner conductor center that is located at a second position within the dielectric structure 104 that is approximately at a second center position 404 that is equal to approximately half of a dielectric structure width 126 of the dielectric structure 104 along a Y-axis 128. Furthermore, the CE 502 may be an approximately rectangular like conductive strip that is located below the combination of the PAE 200 and antenna slot 204 and top dielectric layer 108, and above the inner conductor 106 in or on the CE dielectric layer 506. The CE 502 has a CE length 520 that may extend outward from the inner conductor width 406 at a predetermined angle. In this example, a fourth cutting plane D-D' 522 is shown cutting through the dielectric structure 104 at the location of the CE 502 and looking into the ACMWT 500.

As discussed earlier, in an example of operation, in one direction, the input signal 132 travels through the waveguide 114 in a direction along the negative Z-axis 130 until it reaches the combination of the PAE 200 and antenna slot 204 on the waveguide backend surface 202 at the waveguide backend 118. Once the input signal 132 reaches the combination of the PAE 200 and antenna slot 204, the resulting electromagnetic field at the combination of the PAE 200 and antenna slot 204 couples between the PAE 200, CE 502, and the inner conductor 106 producing the input TEM signal 122 that travels between the inner conductor 106 and bottom conductor 112 in a direction along the negative X-axis 124. In the other direction, the ACMWT 500 is also configured to receive the output TEM signal 138, at the second port 136, that is injected between the inner conductor 106 and bottom conductor 112 along the direction of the X-axis 124 and, in response, produces the output signal 140 that is transmitted along the waveguide 114, at the first port 134, along the direction of the Z-axis 130. In this example, it is appreciated that the waveguide shown in FIG. 5 may be also either the rectangular waveguide 114 or the elliptical waveguide 302. It is appreciated by those of ordinary skill in the art that the electromagnetic characteristics of the input TEM signal 122 are determined by the geometry (or shape), dimensions (e.g., radius, thickness), and position of the PAE 200 along the top surface 110, the geometry and dimensions (e.g., slot length and slot width) of the antenna slot 204 within the PAE 200, and the position, geometry and dimensions (e.g., length and width) of the CE 502 within the dielectric structure 104.

Again, in this example, the inner conductor 106 is shown to be located within a middle dielectric layer 504 and the CE 502 is located between the inner conductor 106 and the combination of the PAE 200 with the antenna slot 204 within or on the CE dielectric layer 506 below the top dielectric layer 108 and above the middle dielectric layer 504. Based on the fabrication method utilized in producing the ACMWT 500, the middle dielectric layer 504 may be a dielectric layer from the plurality of dielectric layers 102 or a dielectric layer formed from an adhesive layer of the plurality of adhesive layers 508, or combination of both.

The addition of the CE 502 in the ACMWT 500 decreases the axial ratio and increases the circular polarization bandwidth without increasing the size of an antenna array utilizing the ACMWT 500.

As discussed earlier, the ACMWT 500 may include an optional rigid surface layer that is located on top of the top surface 110 that covers the top dielectric layer 108 and is physically attached to the waveguide 114 at or near the waveguide backend 118. The optional rigid surface layer adds physical strength and rigidity to the waveguide 114 and allows it to interface with an external waveguide (not shown) without causing physical damage to the ACMWT 500. The optional rigid surface layer may have a thickness that is approximately equal to the height of the waveguide 114 so as to incorporate the waveguide 114 within the optional rigid surface layer and may include screw holes (not shown) around an opening of waveguide cavity 120 to attach the waveguide 114 and optional rigid surface layer to a flange of an external waveguide (not shown). Again, based on the design of the optional rigid surface layer, the optional rigid surface layer may be constructed of metal, plastics, or other rigid materials.

Figure 6:
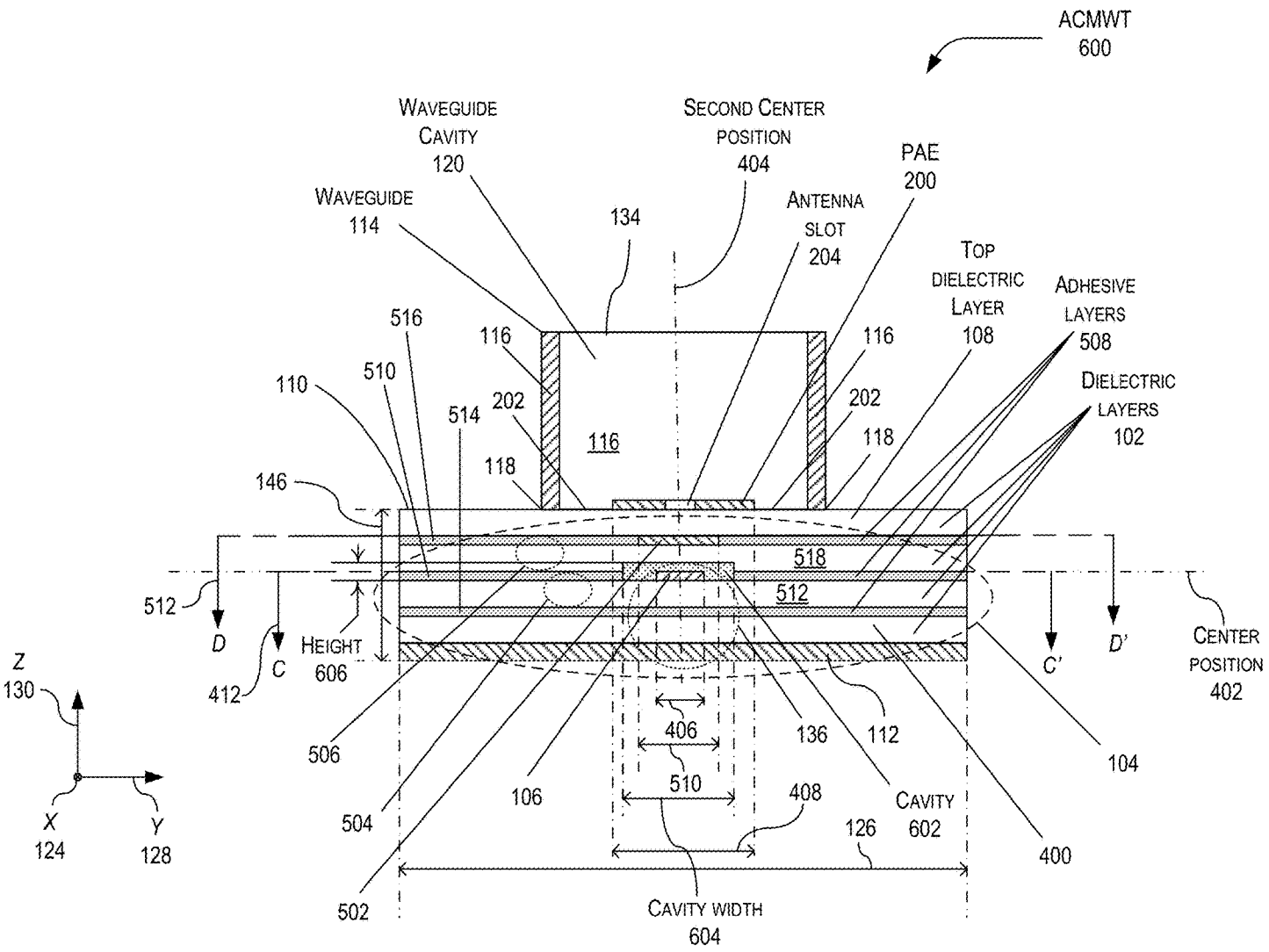
FIG. 6 is a cross-sectional front-view of an example of yet another implementation of the ACMWT (shown in FIG. 1) in accordance with the present disclosure.

Turning to FIG. 6, a cross-sectional front-view of an example of yet another implementation of the ACMWT 600 is shown in accordance with the present disclosure. Similar to the example described in relation to FIG. 5, in this view, the dielectric structure 104, plurality of dielectric layers 102, top dielectric layer 108, bottom dielectric layer 400, stack-up height 146, inner conductor 106, top surface 110, bottom conductor 112, waveguide 114, waveguide wall 116, waveguide cavity 120, waveguide backend 118, waveguide backend surface 202, CE 502, PAE 200, and antenna slot 204 are shown. Again, in this example, each of the dielectric layers of the plurality of dielectric layers 102 are RF dielectrics.

In this example, the ACMWT 600 is again shown to have a center position 402 that may be located at approximately half of the stack-up height 146 and a second center position 404 that is located at approximately half of the dielectric structure width 126 of the dielectric structure 104.

The difference between this example and the one described in relation to FIG. 5 is that in this example the ACMWT 600 includes a cavity 602 within the ACMWT 600 to improve the electromagnetic performance of the ACMWT 600. In this example, the cavity 602 may be located within the dielectric structure 104 between the inner conductor 106 and the PAE 200 at the middle dielectric layer 504, CE dielectric layer 506, and/or adhesive layer between the middle dielectric layer 504 and CE dielectric layer 506. The cavity 602 is centered about the inner conductor 106 with a cavity width 604, which is greater than the inner conductor width 406. The cavity 602 may also have a cavity height 606 that is greater than or approximately equal to the height of the inner conductor 106. The cavity 602, for example, may be filled with air.

In this example, cavity 602 may have a circular perimeter such that the cavity width 604 may be approximately equal to the width of the PAE 200. Alternatively, the diameter of the cavity (i.e., cavity width 604) may be more or less than the PAE diameter 408 of the PAE 200. In general, the cavity width 604 is a predetermined value that is based on the design of the ACMWT 600 such as to enhance and approximately optimize the gain and bandwidth of the CE 502 and PAE 200 with the antenna slot 204.

As discussed earlier, the ACMWT 600 may include an optional rigid surface layer that is located on top of the top surface 110 that covers the top dielectric layer 108 and is physically attached to the waveguide 114 at or near the waveguide backend 118. The optional rigid surface layer adds physical strength and rigidity to the waveguide 114 and allows it to interface with an external waveguide (not shown) without causing physical damage to the ACMWT 600. The optional rigid surface layer may have a thickness that is approximately equal to the height of the waveguide 114 so as to incorporate the waveguide 114 within the optional rigid surface layer and may include screw holes (not shown) around an opening of waveguide cavity 120 to attach the waveguide 114 and optional rigid surface layer to a flange of an external waveguide (not shown). Again, based on the design of the optional rigid surface layer, the optional rigid surface layer may be constructed of metal, plastics, or other rigid materials.

Figure 7:
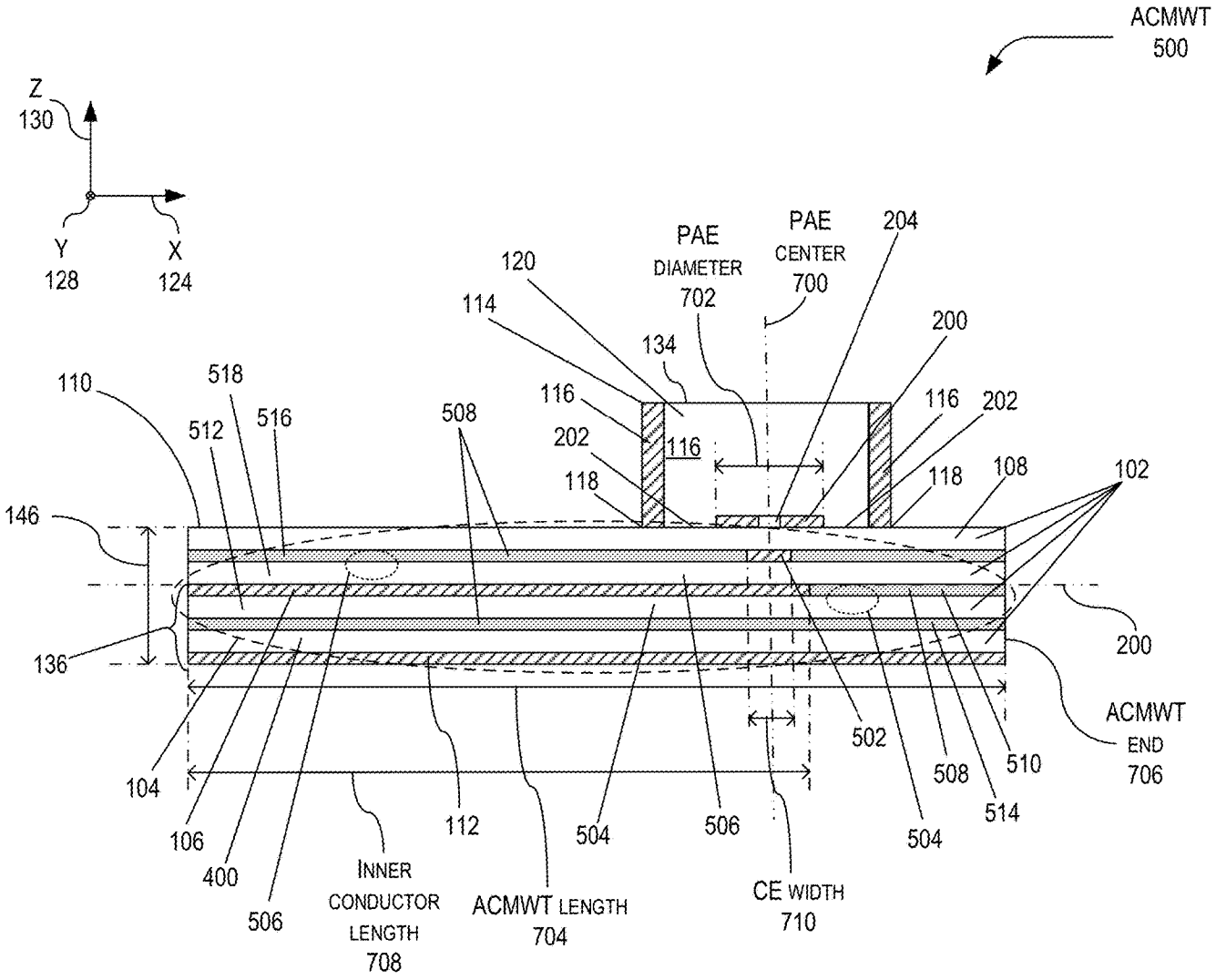
FIG. 7 is a cross-sectional side-view of the ACMWT, shown in FIG. 5, in accordance with the present disclosure.

In FIG. 7, a cross-sectional side-view of the ACMWT 500 (shown in FIG. 5) is shown in accordance with the present disclosure. In this view, the dielectric structure 104, plurality of dielectric layers 102, top dielectric layer 108, bottom dielectric layer 400, middle dielectric layer 504, CE dielectric layer 506, plurality of adhesive layers 508, adhesive layer 510, dielectric layer 512, adhesive layer 514, adhesive layer 516, dielectric layer 518, stack-up height 146, inner conductor 106, top surface 110, bottom conductor 112, waveguide 114, waveguide wall 116, waveguide cavity 120, waveguide backend 118, waveguide backend surface 202, center position 402, first port 134, second port 136, CE 502, PAE 200, and antenna slot 204 are shown. The PAE 200 has a PAE center 700 located at the center of the PAE 200 and a PAE diameter 702. The ACMWT 500 also has an ACMWT length 704 that extends from the second port 136 to an end 706 of the ACMWT 500 and the inner conductor 106 has an inner conductor length 708. In this example the inner conductor length 708 is shown to extend a little past a CE width 710 but without extending beyond the PAE diameter 702. It is appreciated by those of ordinary skill in the art that the actual end of the inner conductor length 708 is predetermined by the design of the ACMWT 500.

Figure 8A:
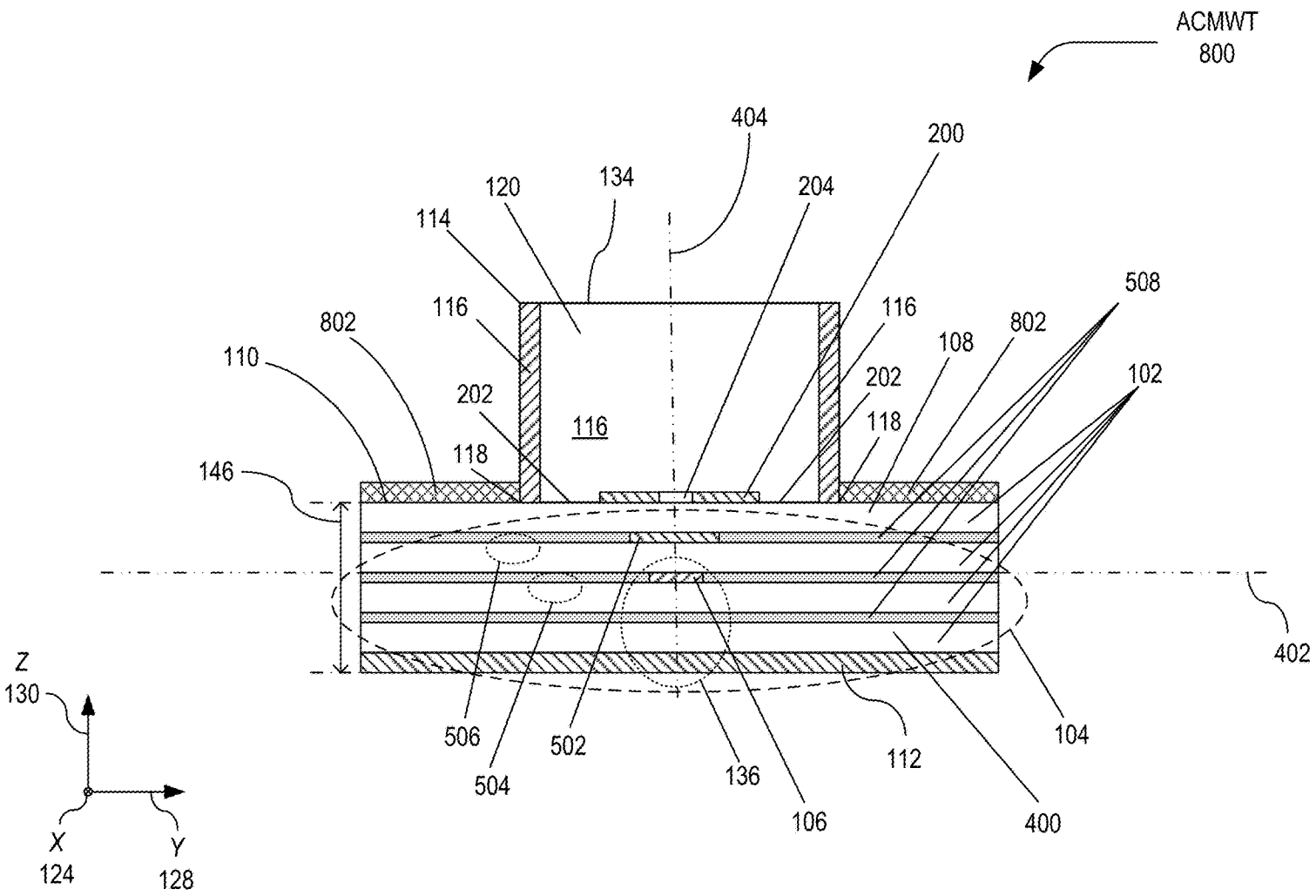
FIG. 8A is a cross-sectional front-view of an example of still another implementation of the ACMWT in accordance with the present disclosure.

Turning to FIG. 8A, a cross-sectional front-view of an example of still another implementation of the ACMWT 800 is shown in accordance with the present disclosure. In this example, the ACMWT 800 includes a rigid surface layer 802 on top surface 110 of the top dielectric layer 108 of the ACMWT 800. The rigid surface layer 802 covers the top dielectric layer 108 and is physically attached to the waveguide 114 at or near the waveguide backend 118. In this example, the rigid surface layer 802 adds physical strength and rigidity to the waveguide 114 without causing physically damage to the ACMWT 800.

Figure 8B:
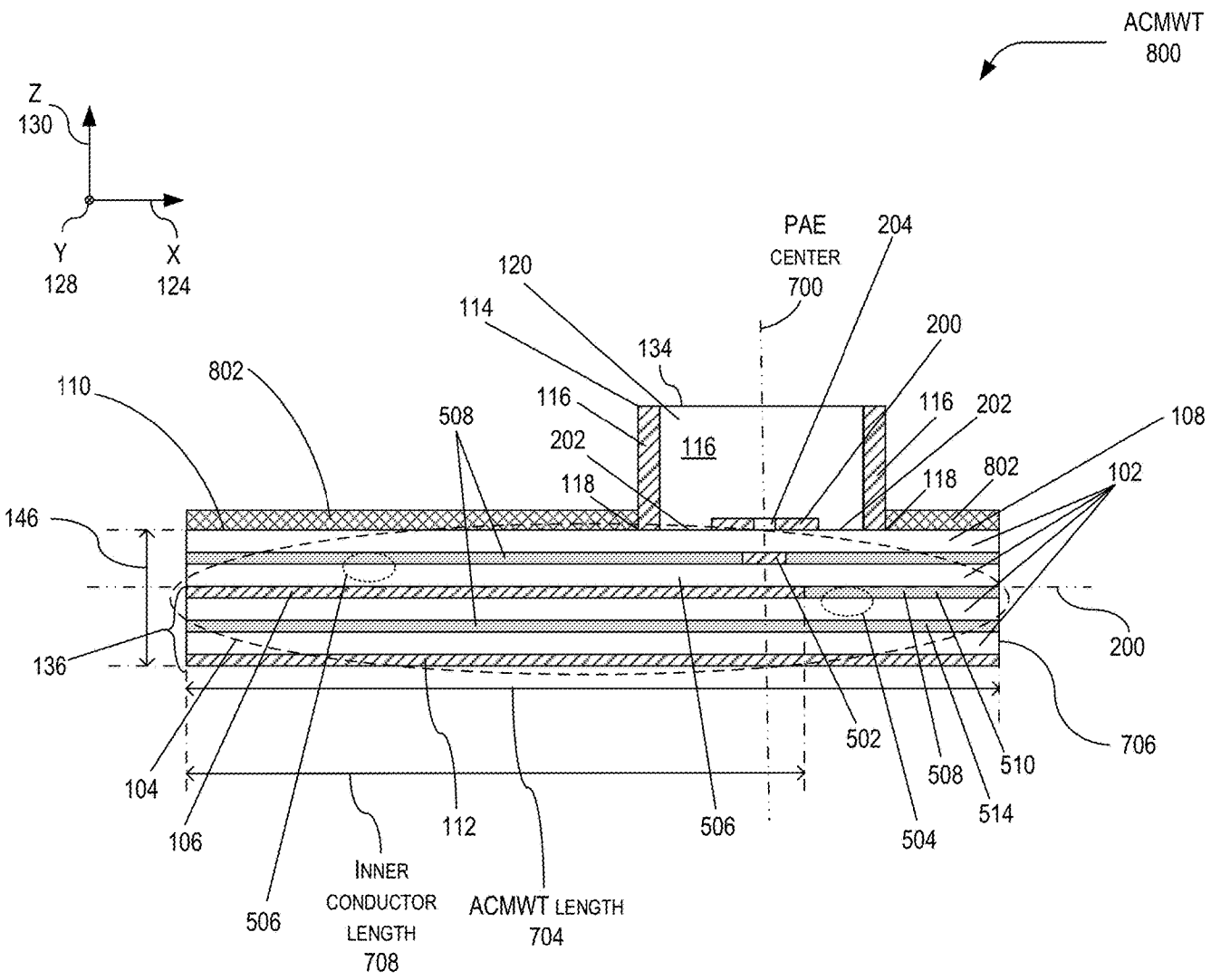
FIG. 8B is a cross-sectional side-view of the ACMWT, shown in FIG. 8A, in accordance with the present disclosure.

As an example, the rigid surface layer 802 may be thick enough to incorporate the waveguide 114 within the optional rigid surface layer 802 and may include screw holes (not shown) around an opening of waveguide cavity 120 to attach the waveguide 114 and the rigid surface layer 802 to a flange of an external waveguide (not shown). Based on the design of the rigid surface layer 802, the rigid surface layer 802 may be constructed of metal, plastics, or other rigid materials. If the rigid surface layer 802 is fabricated from or includes a metal or other conductive material, the rigid surface layer 802 may act as a ground plane for the waveguide walls 116. In FIG. 8B, a cross-sectional side-view of the ACMWT 800 is shown in accordance with the present disclosure.

Figure 9A:
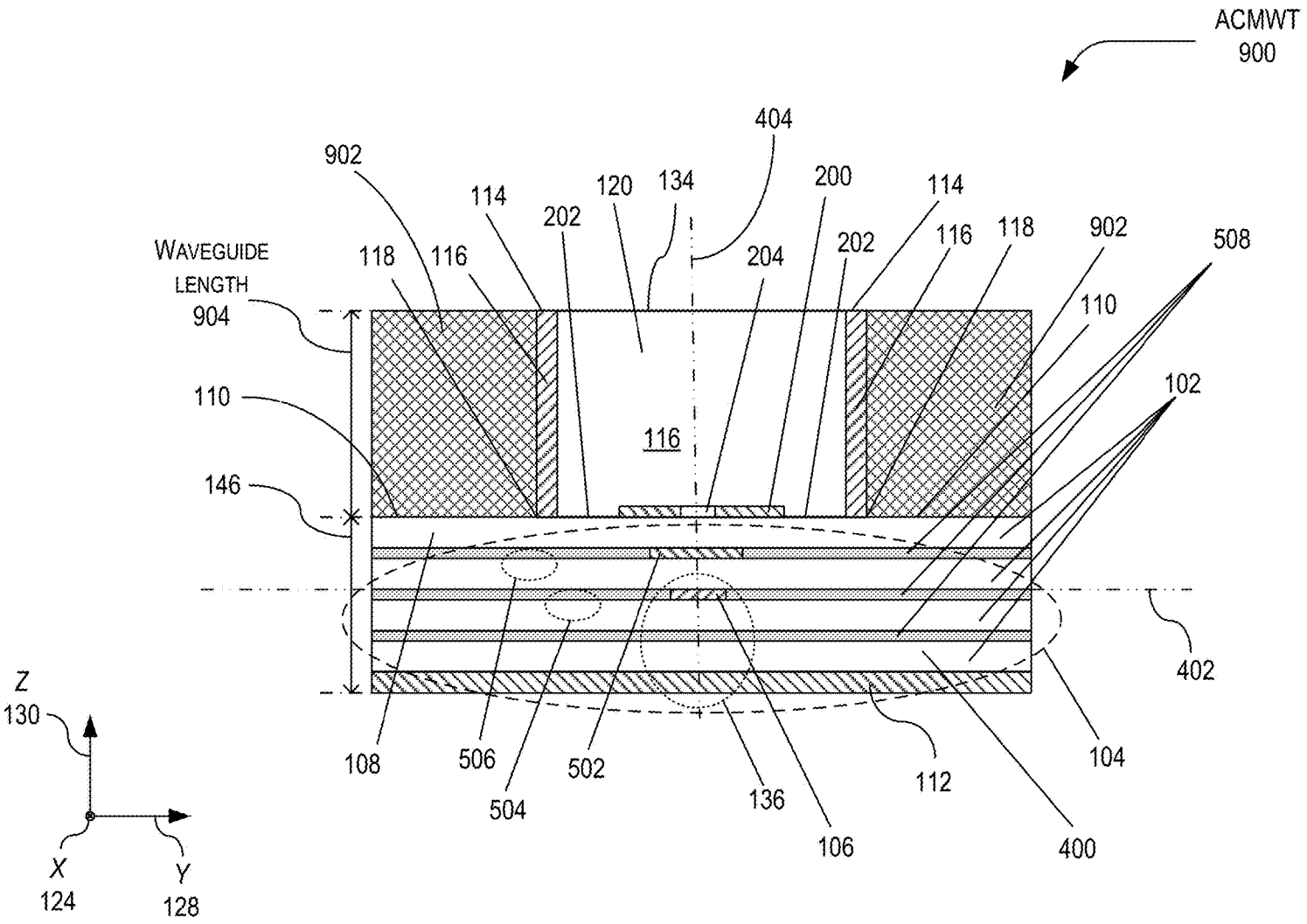
FIG. 9A is a cross-sectional front-view of an example of yet another implementation of the ACMWT in accordance with the present disclosure.
Figure 9B:
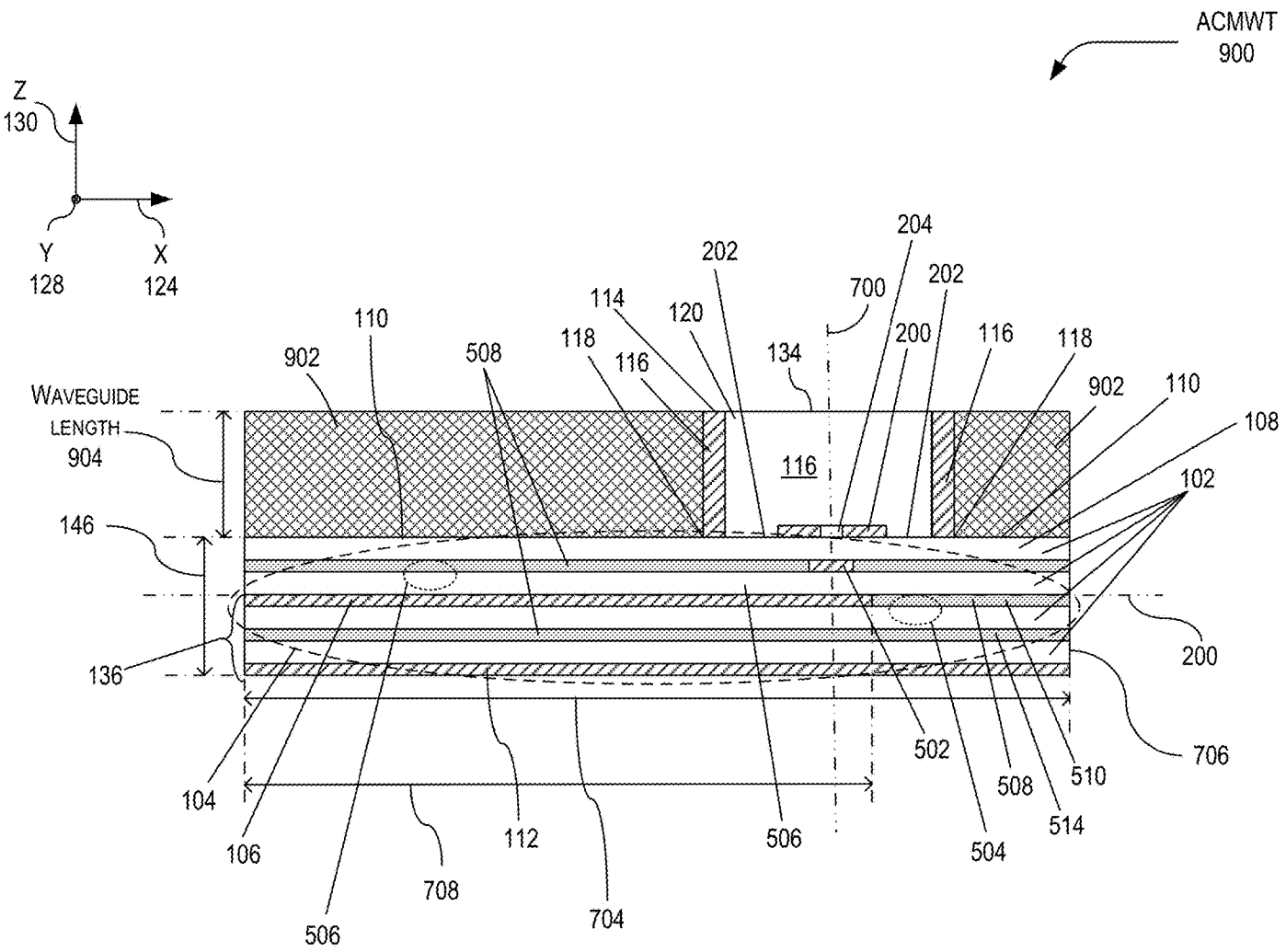
FIG. 9B is a cross-sectional side-view of the ACMWT, shown in FIG. 9A, in accordance with the present disclosure.
Figure 9C:
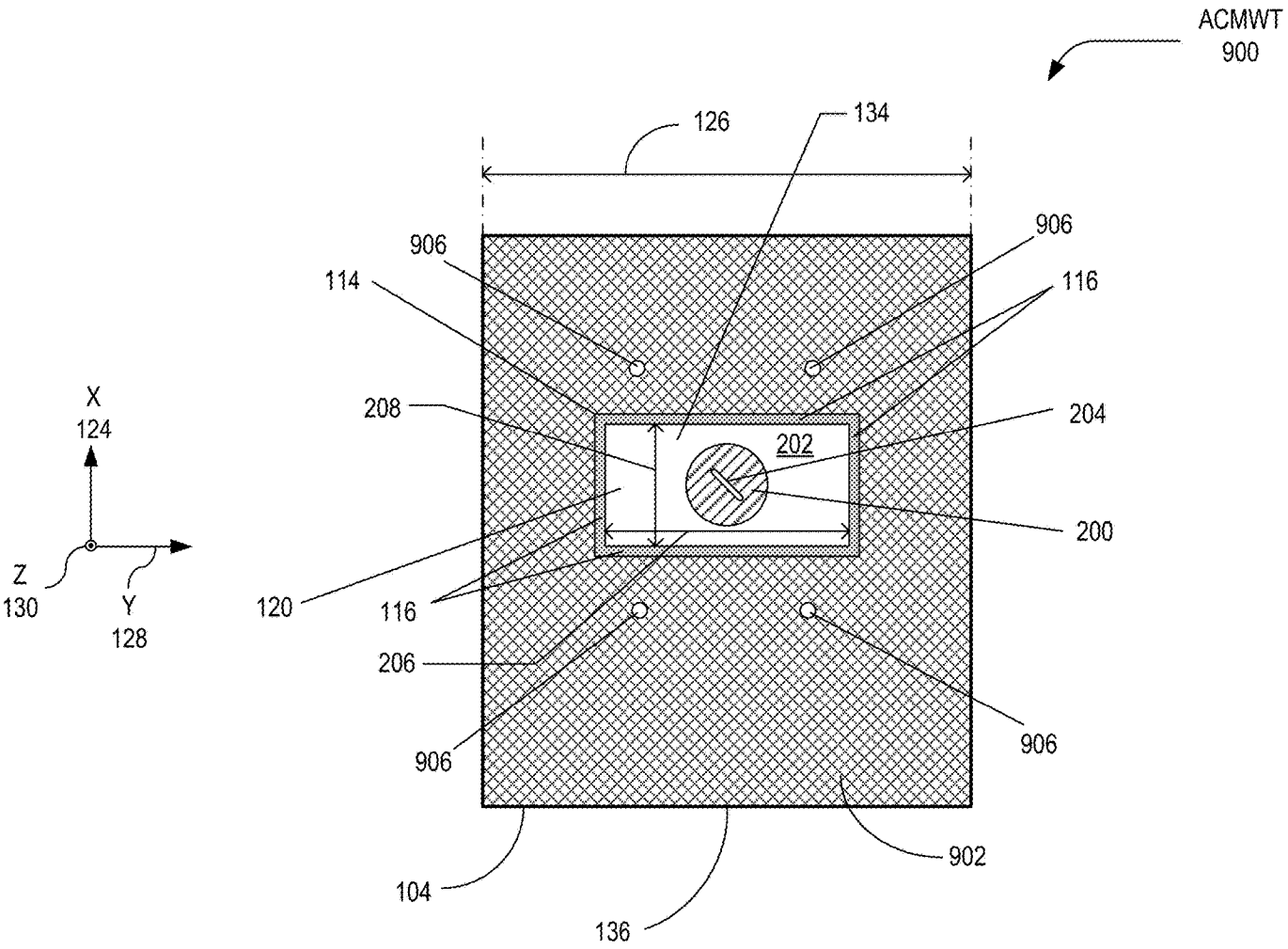
FIG. 9C is a top view of the ACMWT, shown in FIGS. 9A and 9B, in accordance with the present disclosure.

In FIG. 9A, a cross-sectional front-view of an example of another implementation of the ACMWT 900 having a rigid surface layer 902 is shown in accordance with the present disclosure. In this example, the rigid surface layer 902 has a height that is approximately equal to the waveguide length 904. FIG. 9B is a cross-sectional side-view of the ACMWT 900 in accordance with the present disclosure and FIG. 9C is a top view of the ACMWT 900 in accordance with the present disclosure. In FIG. 9C, four screw holes 906 are shown that penetrate into the rigid surface layer 902. The four screw holes 906 may be utilized to attach an external waveguide flange (not shown) on to the ACMWT 900. It is appreciated that in this example, the waveguide may be either the rectangular waveguide 114 or elliptical waveguide 302.

Figure 10:
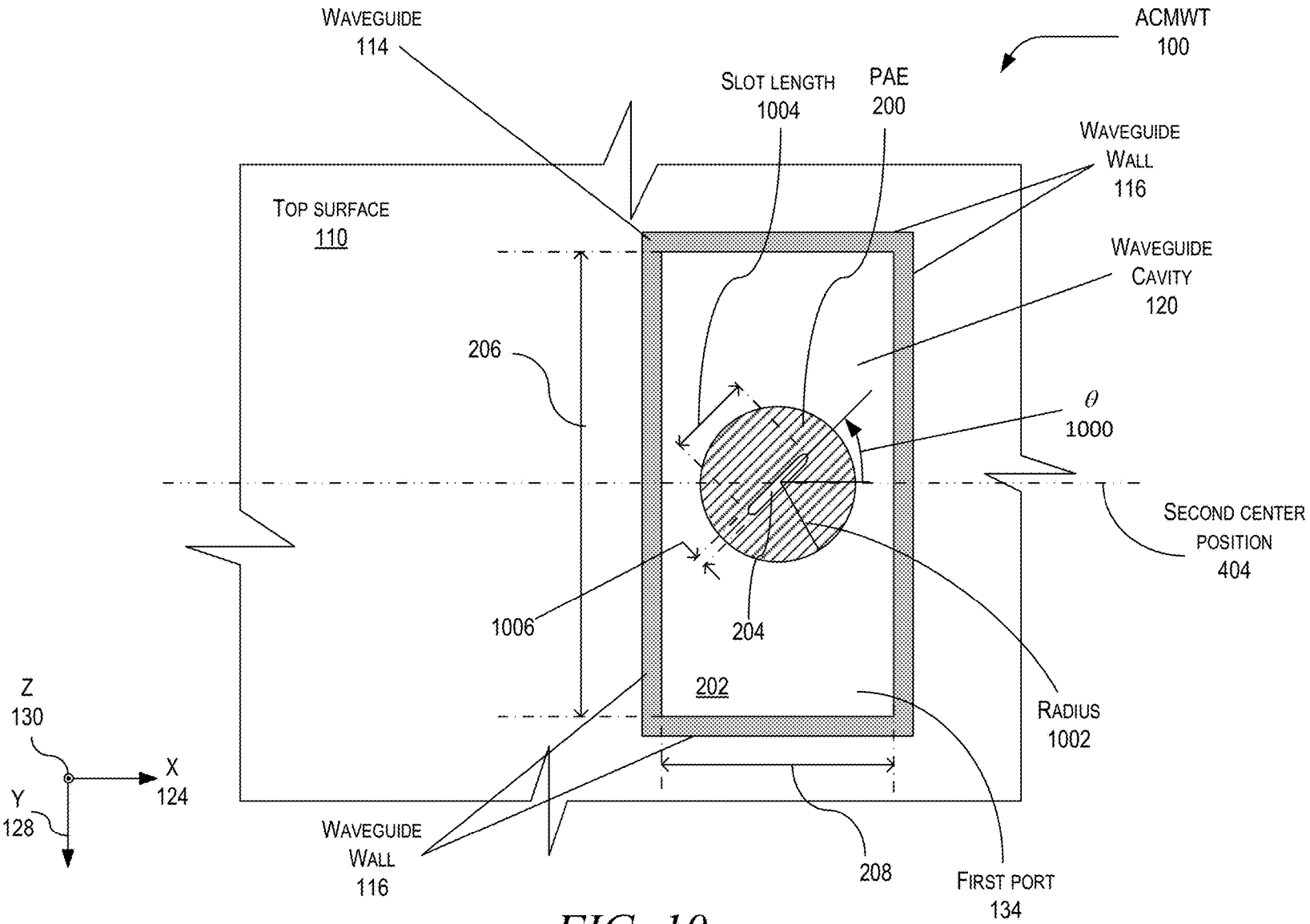
FIG. 10 is a zoomed-in view of the PAE and antenna slot within the ACMWT, shown in FIG. 1, in accordance with the present disclosure.

Turning to FIG. 10, a zoomed-in view of the PAE 200 and antenna slot 204 within the ACMWT 100 are shown in accordance with the present disclosure. In this example, the antenna slot 204 is shown within the PAE 200 at an angle θ 1000 with respect to the inner conductor 106 along the second center position 404. In this example, the antenna slot 204 is shown to be centered about the second center position 404. The angle θ 1000 may be negative or positive. In this example, the PAE 200 is shown to have a circular shape with a radius 1002. As discussed earlier, the geometry (or shape), dimensions (e.g., radius, thickness), and position of the PAE 200 along the top surface 110 and the geometry and dimensions (e.g., slot length and slot width) of the antenna slot 204 within the PAE 200 determine the electromagnetic characteristics of the radiated output signal 140 or received input TEM signal 122. Moreover, in this example, the PAE 200 is circular with the radius 1002 and the antenna slot 204 has a slot length 1004 and slot width 1006. In this example, the antenna slot 204 may be rectangular in shape. In general, the radius 1002 of the PAE 200 and the slot length 1004 and slot width 1006 are predetermined to enhance and approximately optimize/maximize the either the radiated output signal 140 or the received input TEM signal 122 produced by the CE 502 and PAE 200 (with the antenna slot 204) at a predetermined operating frequency. It is appreciated by those of ordinary skill in the art that other geometries may also be utilized in the present disclosure without departing from the spirit or principles disclosed herein. In this example, the radius 1002 is equal to half of the PAE diameter (e.g., PAE diameter 408 or PAE diameter 702).

Figure 11:
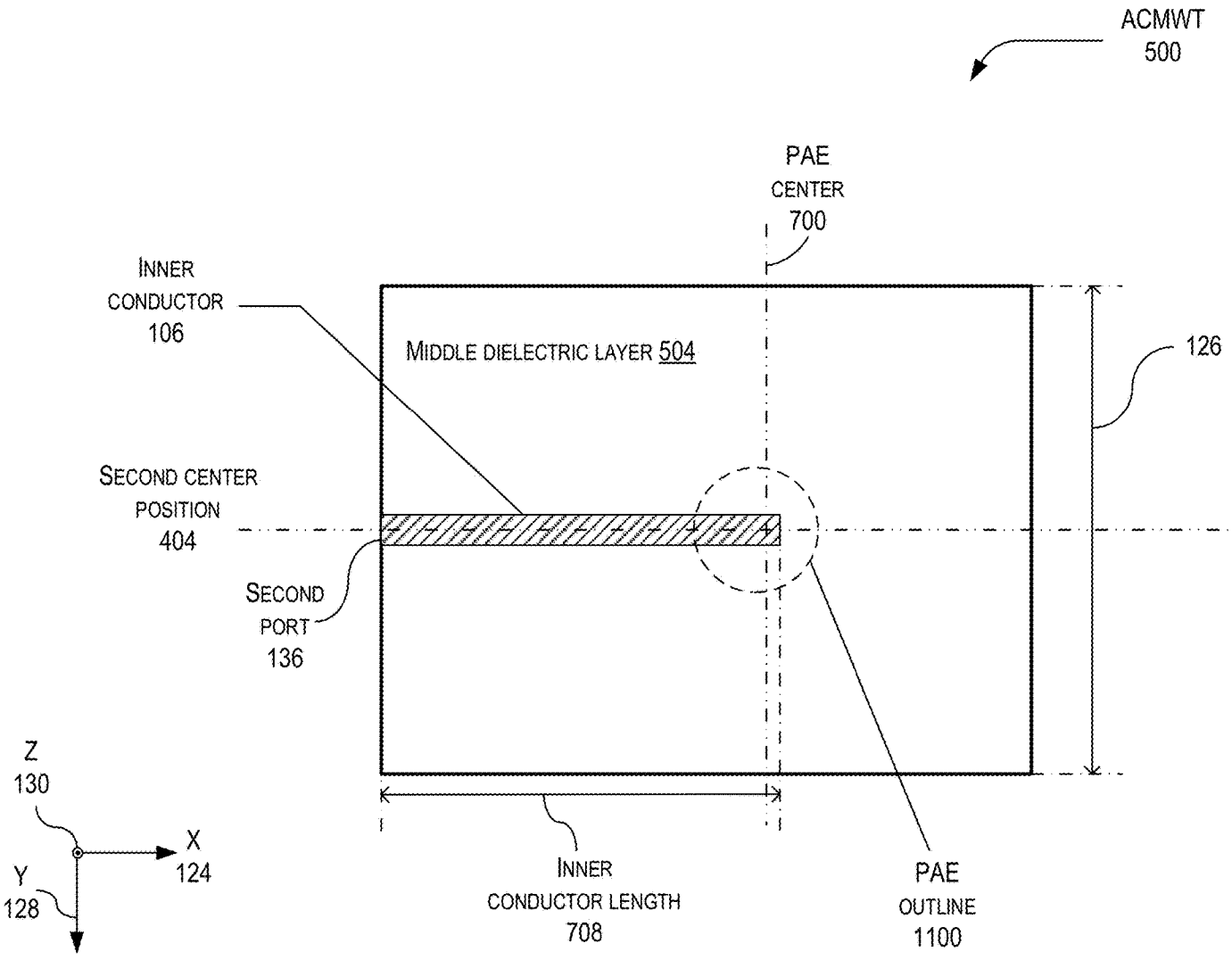
FIG. 11 is a cross-sectional view along a cutting plane showing an inner conductor running along the ACMWT length in accordance with the present disclosure.

FIG. 11 is a cross-sectional view along either the first cutting plane A-A' 142 or the third cutting plane C-C' 412 showing the inner conductor 106 running along the ACMWT 500 length (in the direction of the X-axis 124) in accordance with the present disclosure. In this example, the inner conductor 106 is shown to be within the plurality of dielectric layers 102 in the middle dielectric layer 504 of the dielectric structure 104 between two other dielectric layers (not shown). The inner conductor length 708 of the inner conductor 106 extends from the second port 136 to a location under the PAE 200 that may be approximately at or near the PAE center 700. In this example, a PAE outline 1100 of the PAE 200 is shown for reference.

Figure 12:
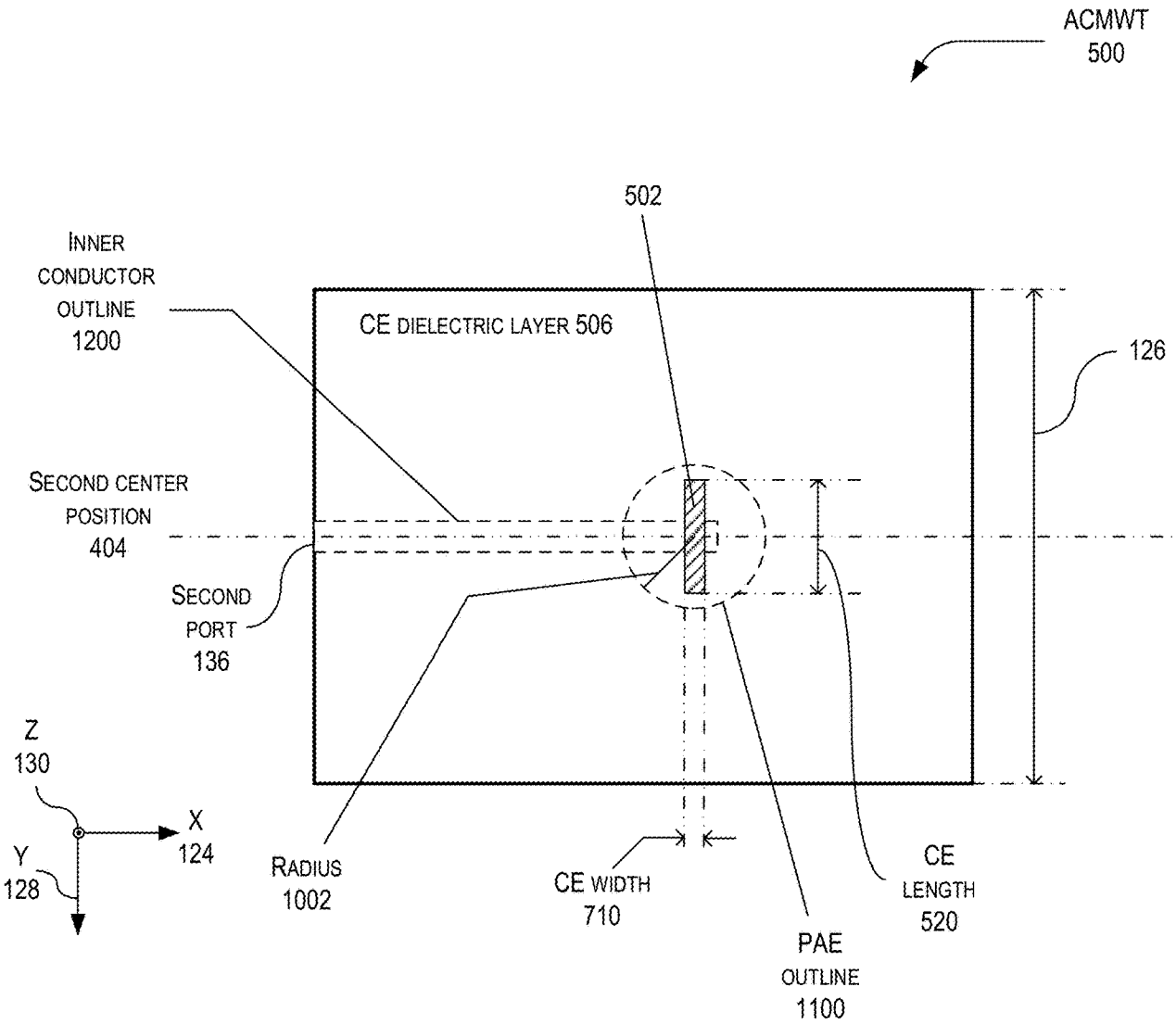
FIG. 12 is a cross-sectional view along a cutting plane showing a CE in accordance with the present disclosure.

FIG. 12 is a cross-sectional view along the fourth cutting plane D-D' 522 showing the CE 502 in accordance with the present disclosure. In this example, the CE 502 is shown as a stub that has the CE length 520 that is approximately orthogonal to the inner conductor length 708 of the inner conductor 106. In this view, the inner conductor 106 is located within the plurality of dielectric layers 102 below the CE dielectric layer 506. The inner conductor 106 is located below the CE 502 and is not visible. Moreover, the PAE 200 and antenna slot 204 are located above the CE 502 on the top dielectric layer 108 and are also not visible. As such, in this view, an inner conductor outline 1200 of the inner conductor 106 and the PAE outline 1100 of the PAE 200 are shown for purposes of illustration. The inner conductor outline 1200 is centered about the second center position 404. In this example, the CE 502 is located below the PAE 200 within the PAE outline 1100 where the CE length 520 is less than or equal to the PAE diameter 702 (i.e., twice the radius 1002) of the PAE outline 1100 and extends approximately orthogonally from the inner conductor outline 1200. In general, the CE length 520, CE width 710, and angle with respect to the inner conductor 106 are predetermined to enhance and approximately optimize the radiated or received signals (i.e., output signal 140 or input TEM signal 122) of the combined PAE 200 and antenna slot 204 at a predetermined operating frequency.

In this disclosure, the inner conductor 106, CE 502, and PAE 200 are designed to be electrically coupled to one another at a predetermined operating frequency. In an example of operation, in one direction, the output TEM signal 138 inserted into the second port 136 traverses between the inner conductor 106 and bottom conductor 112 (as a TEM mode), then electrically couples through the dielectric structure 104 to the CE 502 where the current of the signal is rotated due to the orientation of CE 502 with respect to the inner conductor 106. The signal then electrically couples from CE 502 through the dielectric structure 104 to the PAE 200 where the current of the signal further rotates due to the orientation of PAE 200 with respect to CE 502. The circularly polarized radiated signal is then radiated into the waveguide cavity 120 and propagated along the waveguide 114 (as either a TE or TM mode) to the output signal 140. In the opposite direction, the input signal 132 injected into the first port 134 propagates along the waveguide length 904 (as either a TE mode or TM mode) until it reaches the combined PAE 200 and antenna slot 204. The input signal 132 induces coupling between the combined PAE 200 and antenna slot 204 and inner conductor 106 though the CE 502. The resulting coupled signal is rotated in the opposite direction and traverses between the inner conductor 106 and bottom conductor 112 (as a TEM mode) towards the second port 136 as the input TEM signal 122.

Figure 13:
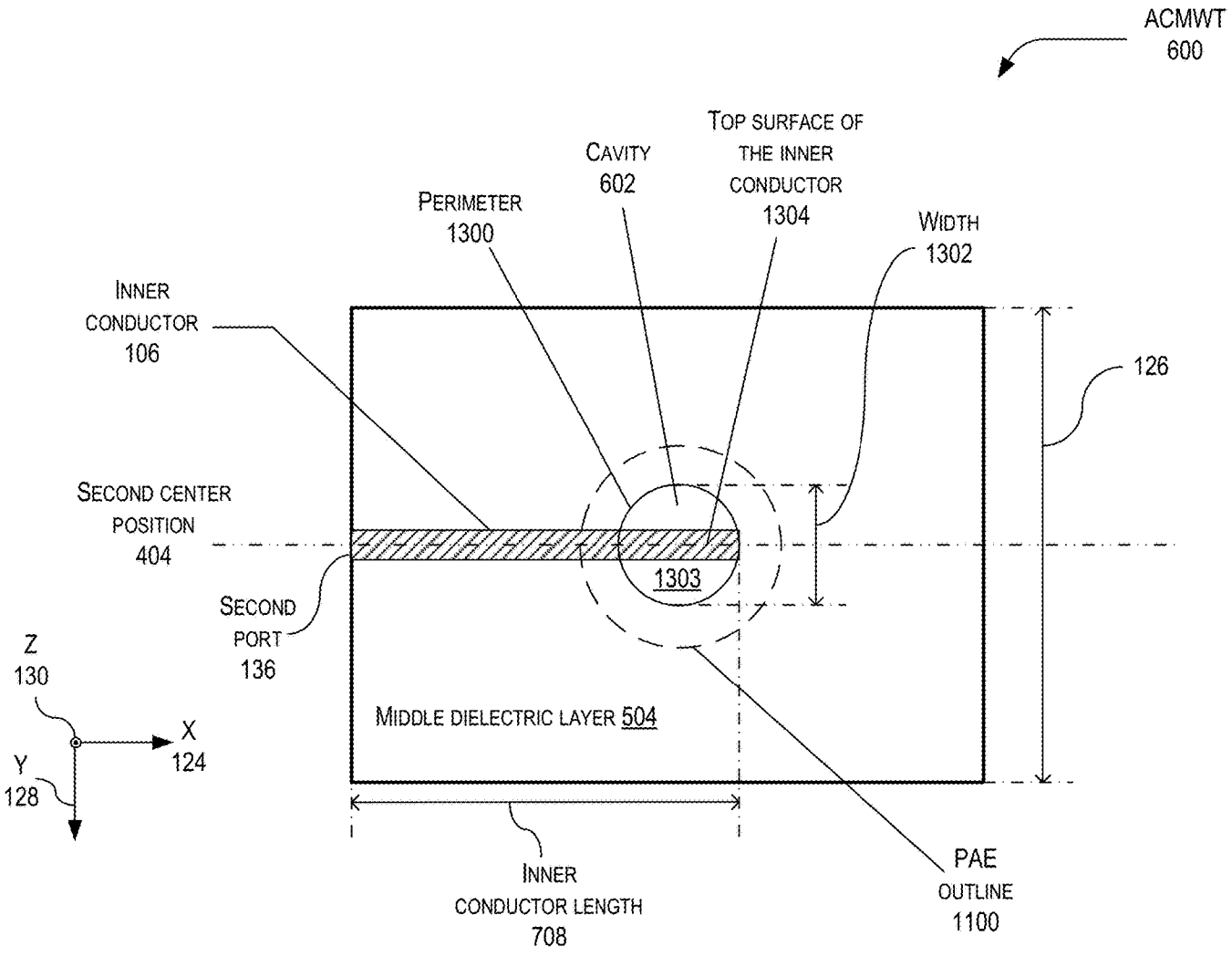
FIG. 13 is a cross-sectional view along a cutting plane showing an example of an implementation of the single cavity in accordance with the present disclosure.

FIG. 13 is a cross-sectional view along either the first cutting plane A-A' 142 or the third cutting plane C-C' 412 showing an example of an implementation of the single cavity 602 in accordance with the present disclosure. In this example, the inner conductor 106 is shown to be in the middle dielectric layer 504 of the dielectric structure 104. The cavity 602 is also shown within the dielectric structure 104 around and above the inner conductor 106. The cavity 602 has a perimeter 1300 that is circular with a diameter equal to the cavity width 1302. In this example, the cavity 602 is shown to cut through the middle dielectric layer 504 exposing a top surface 1303 of the dielectric layer below the middle dielectric layer 504. As in the example shown in FIG. 6, the cavity 602 is located below the PAE 200 and the CE 502 and around and above the inner conductor 106. The cavity width 1302 is approximately equal to or less than the PAE diameter (e.g., PAE diameter 408 and 702). In this example, the cavity 602 is air filled and has the width 1302 and the height 606 occupying the space around the inner conductor 106 and above a top surface 1304 of the inner conductor 106. The cavity 602 may be adjacent to the sides of the portion of the inner conductor 106. In general, the cavity width 1302 is a predetermined value that is based on the design of the ACMWT 600 such as to enhance and approximately optimize the gain and bandwidth of the CE 502 and PAE 200 with the antenna slot 204. While only a single cavity 602 is shown in this example, it is appreciated that in other examples may include multiple cavities within the middle dielectric layer 504.

Turning to FIGS. 14A-14H, a method for fabricating the ACMWT (i.e., ACMWT 100, 300, 500, 600, 800, and 900) utilizing a lamination process is shown. Specifically, in FIG. 14A, a cross-sectional view of a first section 1400 of the ACMWT is shown in accordance with the present disclosure. The first section 1400 of the ACMWT includes a first dielectric layer 1402 with a first conductive layer 1404 patterned on a bottom surface 1406 of the first dielectric layer 1402, where the first dielectric layer 1402 has a top surface 1408 and bottom surface 1406. In this example, the first conductive layer 1404 is the bottom conductor (i.e., bottom conductor 112). In this example, the first conductive layer 1404 may be constructed of a conductive metal such as, for example, electroplated copper or printed silver ink.

Figure 14A:
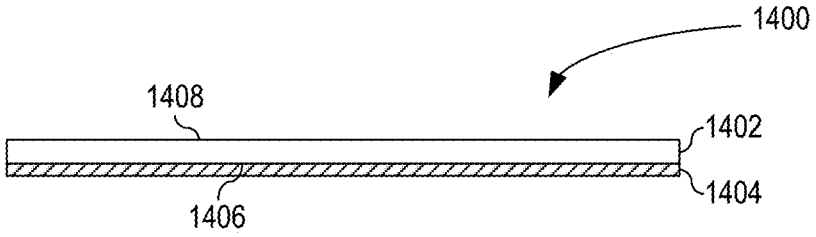
FIG. 14A is a cross-sectional view of a first section of the ACMWT in accordance with the present disclosure.
Figure 14B:
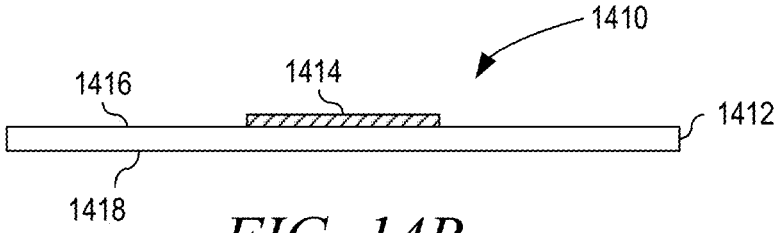
FIG. 14B is a cross-sectional view of a second section of the ACMWT in accordance with the present disclosure.

In FIG. 14B, a cross-sectional view of a second section 1410 of the ACMWT is shown in accordance with the present disclosure. The second section 1410 of the ACMWT includes a second dielectric layer 1412 with a second conductive layer 1414 patterned on a top surface 1416 of the second dielectric layer 1412, where the second dielectric layer 1412 includes a top surface 1416 and bottom surface 1418. In this example, the second conductive layer 1414 is an inner conductor (i.e., inner conductor 106) of the ACMWT. In this example, the second conductive layer 1414 may be constructed of a conductive metal such as, for example, electroplated copper or printed silver ink.

Figure 14C:
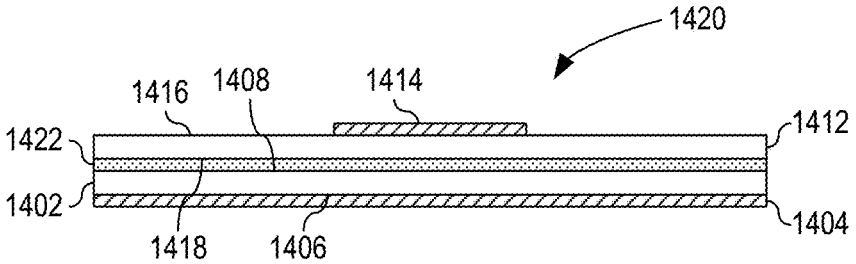
FIG. 14C is a cross-sectional view of a first combination of the first section and the second section of the ACMWT in accordance with the present disclosure.

In FIG. 14C, a cross-sectional view of a first combination 1420 of the first section 1400 and the second section 1410 of the ACMWT is shown in accordance with the present disclosure. The first combination 1420 is formed by laminating the bottom surface 1418 of the second dielectric layer 1412 to the top surface 1408 of the first dielectric layer 1402 with a first adhesive layer 1422 that may be an adhesive film.

Figure 14D:
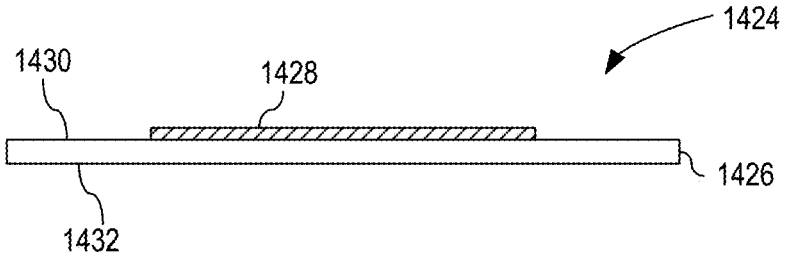
FIG. 14D is a cross-sectional view of a third section of the ACMWT in accordance with the present disclosure.

In FIG. 14D, a cross-sectional view of a third section 1424 of the ACMWT is shown in accordance with the present disclosure. The third section 1424 of the ACMWT includes a third dielectric layer 1426 with a third conductive layer 1428 patterned on a top surface 1430 of the third dielectric layer 1426, where the third dielectric layer 1426 also includes a bottom surface 1432. In this example, the third conductive layer 1428 is the PAE of the ACMWT. In this example, the third conductive layer 1428 may be constructed of a conductive metal such as, for example, electroplated copper or printed silver ink.

Figure 14E:
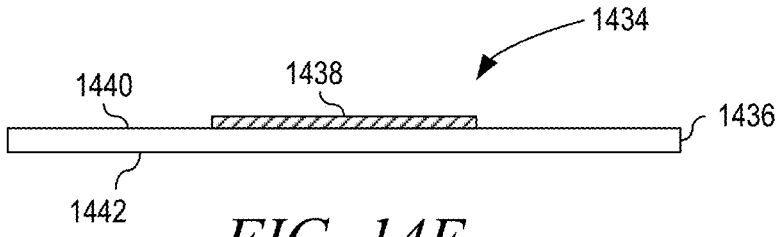
FIG. 14E is a cross-sectional view of a fourth section of the ACMWT is shown in accordance with the present disclosure.

In FIG. 14E, a cross-sectional view of a fourth section 1434 of the ACMWT is shown in accordance with the present disclosure. The fourth section 1434 of the ACMWT includes a fourth dielectric layer 1436 with a fourth conductive layer 1438 patterned on a top surface 1440 of the fourth dielectric layer 1436, where the fourth dielectric layer 1436 also includes a bottom surface 1442. In this example, the fourth conductive layer 1438 is a CE (i.e., CE 502) of the ACMWT. In this example, the fourth conductive layer 1438 may be constructed of a conductive metal such as, for example, electroplated copper or printed silver ink.

Figure 14F:
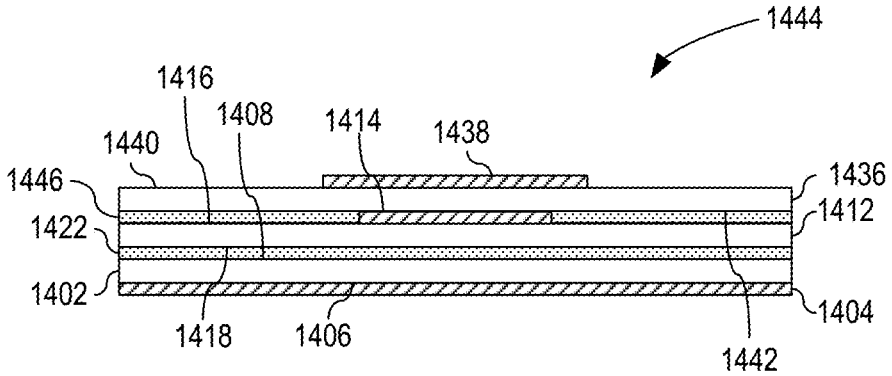
FIG. 14F is a cross-sectional view of a second combination of the first combination and the fourth section of the ACMWT in accordance with the present disclosure.

In FIG. 14F, a cross-sectional view of a second combination 1444 of the first combination 1420 and the fourth section 1434 of the ACMWT is shown in accordance with the present disclosure. The second combination 1444 is formed by laminating the bottom surface 1442 of the fourth dielectric layer 1436 to the top surface 1416 of the second dielectric layer 1412 with a second adhesive layer 1446.

Figure 14G:
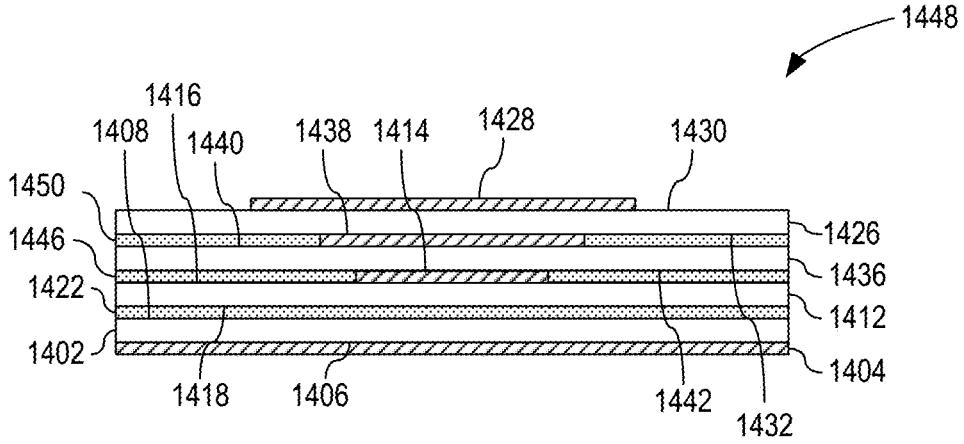
FIG. 14G is a cross-sectional view of a composite laminated structure that includes the second combination and the third section of the ACMWT in accordance with the present disclosure.

In FIG. 14G, a cross-sectional view of a composite laminated structure 1448 that includes the second combination 1444 and the third section 1424 of the ACMWT is shown in accordance with the present disclosure. In the composite laminated structure 1448, the bottom surface 1432 of the third dielectric layer 1426 is laminated on to the top surface 1440 of the fourth dielectric layer 1436 with a third adhesive layer 1450 producing the composite laminated structure 1448 that is also the dielectric structure (e.g., dielectric structure 104).

Figure 14H:
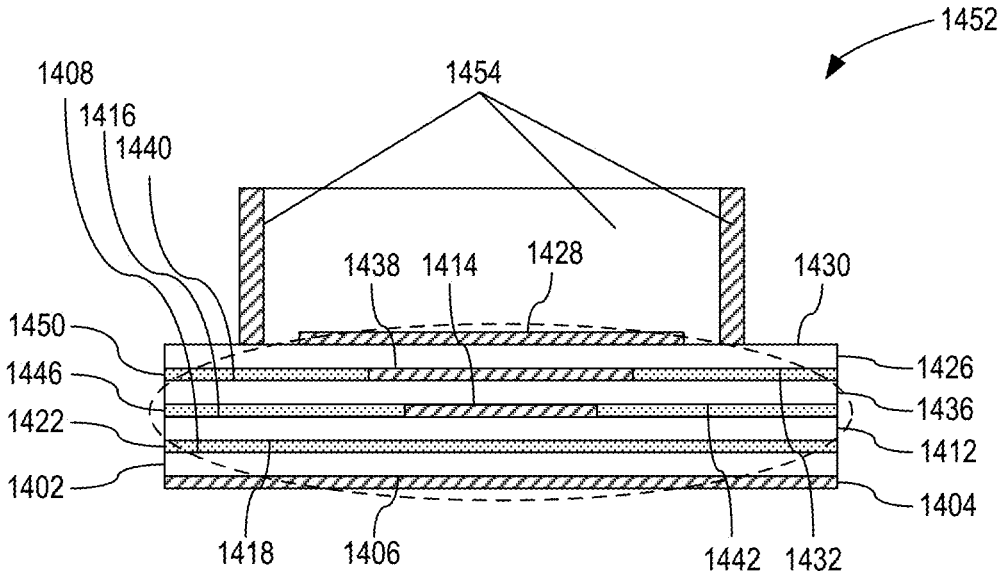
FIG. 14H is a cross-sectional view of a combined structure of the ACMWT in accordance with the present disclosure.

In FIG. 14H, a cross-sectional view of a combined structure 1452 of the ACMWT is shown in accordance with the present disclosure. In this view, the waveguide walls 1454 (e.g., waveguide walls 116 or waveguide wall 304) are attached to the composite laminated structure 1448 on the top surface 1430 of the third dielectric layer 1426.

As discussed earlier, the ACMWT may also include laminating a rigid surface layer (not shown) on the top surface 1430 of the third dielectric layer 1426 so as to establish a rigid base for the waveguide walls 1454. The thickness of this rigid surface layer may vary based on the design of the ACMWT such as a smaller thickness as shown in FIGS. 8A and 8B to a thickness that is approximately equal to the waveguide length 904 as shown in FIGS. 9A through 9C.

Moreover, as described in relation to FIG. 6, the ACMWT may include an optional cavity (that may be filled with air) about the second conductive layer 1414 (i.e., the inner conductor 106). This optional cavity may be formed within the fourth dielectric layer 1436 and/or the second adhesive layer 1446. In this example, the fourth dielectric layer 1436 may include sub-sections of the fourth dielectric layer 1436 to produce at least one cavity that may be about (i.e., surround) the second conductive layer 1414.

In these examples, the first dielectric layer 1402, second dielectric layer 1412, third dielectric layer 1426, and fourth dielectric layer 1436 may be constructed of an RF dielectric material such as, for example, Pyralux®. Moreover, each of these dielectric layers 1402, 1412, 1426, and 1436 may be laminated to each other with first, second, and third adhesive layers 1422, 1446, and 1450, respectively, where each adhesive layer 1422, 1446, and 1450 may be an adhesive film, adhesive tape, bonding film, or other adhesive material.

Figure 15:
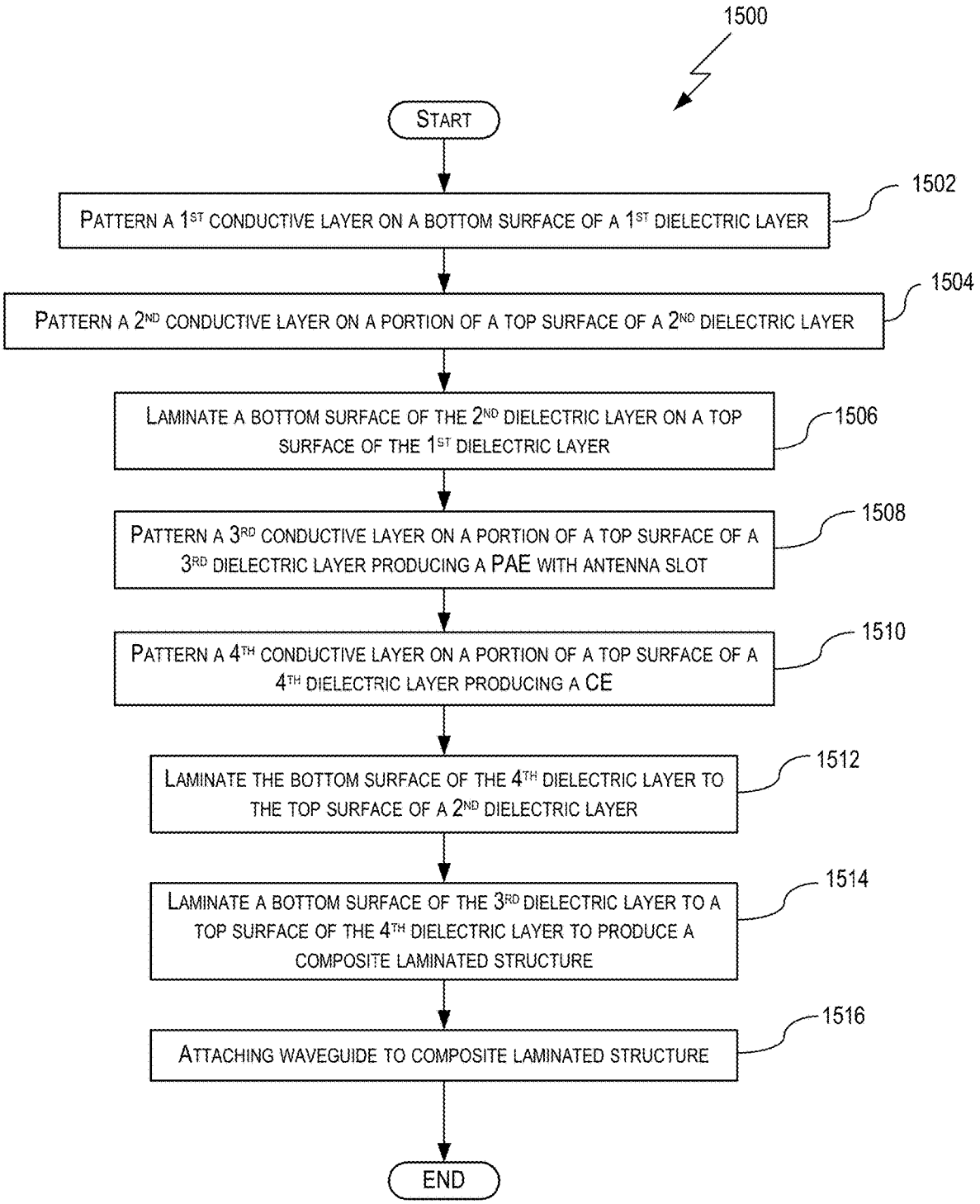
FIG. 15 is a flowchart of an example implementation of a method for fabricating the ACMWT utilizing a lamination process in accordance with the present disclosure.

In FIG. 15, a flowchart is shown of an example implementation of a method 1500 for fabricating the ACMWT utilizing a lamination process in accordance with the present disclosure. The method 1500 is related to the method for fabricating the ACMWT (i.e., ACMWT 100, 300, 500, 600, 800, and 900) utilizing the lamination process described in FIGS. 14A-14H. The method 1500 starts by patterning 1502 the first conductive layer 1404 on the bottom surface 1406 of the first dielectric layer 1402 to produce a bottom conductor 112 acting as a reference ground plane. The method 1500 additionally includes patterning 1504 the second conductive layer 1414 on a portion of the top surface 1416 of a second dielectric layer 1412 to produce the inner conductor 106. The method 1500 also includes laminating 1506 the bottom surface 1418 of the second dielectric layer 1412 to the top surface 1408 of the first dielectric layer 1402. The method 1500 also includes patterning 1508 the third conductive layer 1428 on a portion of the top surface 1430 of the third dielectric layer 1426 to produce the PAE 200 with the antenna slot 204. The method 1500 additionally includes patterning 1510 the fourth conductive layer 1438 on a portion of the top surface 1440 of the fourth dielectric layer 1436 to produce the CE 502. The method 1500 further includes laminating 1512 the bottom surface 1442 of the fourth dielectric layer 1436 to the top surface 1416 of the second dielectric layer 1412 to produce the second combination 1444. The method 1500 further includes laminating 1514 the bottom surface 1432 of the third dielectric layer 1426 to the top surface 1440 of the fourth dielectric layer 1436 to produce the composite laminated structure 1448 that is the dielectric structure (e.g., dielectric structure 104). The method 1500 then includes attaching 1516 the waveguide to the composite laminated structure 1448.

In this example, the method 1500 may utilize a sub-method where one or more of the first conductive layer 1404, second conductive layer 1414, third conductive layer 1428, and fourth conductive layer 1438 are formed by a subtractive method (e.g., wet etching, milling, or laser ablation) of electroplated or rolled metals or by an additive method (e.g., printing or deposition) of printed inks or deposited thin-films. The method 1500 then ends.

In FIGS. 16A-16K, a method for fabricating the ACMWT (i.e., ACMWT 100, 300, 500, 600, 800, and 900) utilizing an additive 3-D printing process is shown.

Figure 16A:
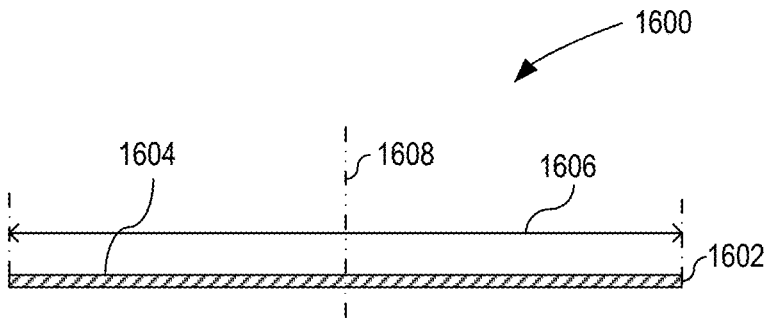
FIG. 16A is a cross-sectional view of first section of the ACMWT in accordance with the present disclosure.

Specifically, in FIG. 16A, a cross-sectional view of a first section 1600 of the ACMWT is shown in accordance with the present disclosure. The first section 1600 of the ACMWT includes a printed first conductive layer 1602 with a top surface 1604 and a first width 1606, where the first width 1606 has a first center 1608. The printed first conductive layer 1602 is the bottom conductor 112 acting as a reference ground plane.

Figure 16B:
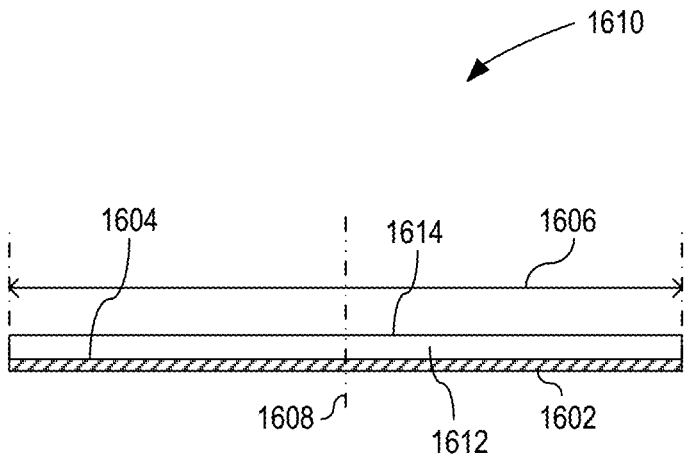
FIG. 16B is a cross-sectional view of a first combination of the first section with a printed first dielectric layer in accordance with the present disclosure.

In FIG. 16B, a cross-sectional view of a first combination 1610 of the first section 1600 with a printed first dielectric layer 1612 is shown in accordance with the present disclosure. In this example, the printed first dielectric layer 1612 has a top surface 1614 that is printed on the top surface 1604 of the printed first conductive layer 1602.

Figure 16C:
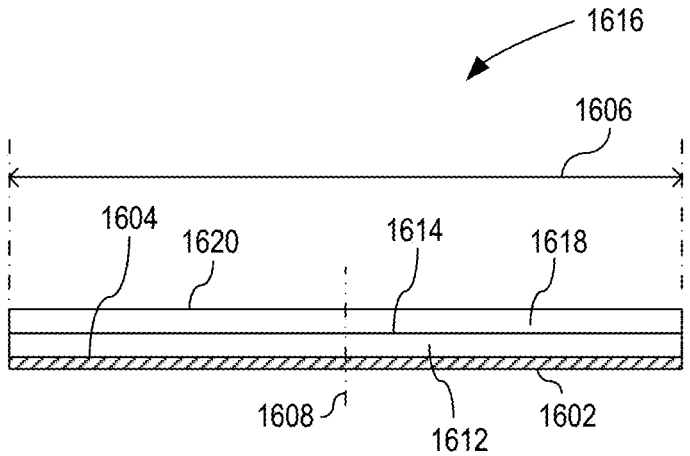
FIG. 16C is a cross-sectional view of a second combination of the first combination with a printed second dielectric layer in accordance with the present disclosure.

In FIG. 16C, a cross-sectional view of a second combination 1616 of the first combination 1610 with a printed second dielectric layer 1618 is shown in accordance with the present disclosure. In this example, the printed second dielectric layer 1618 has a top surface 1620 and is printed on the top surface 1614 of the first dielectric layer 1612.

Figure 16D:
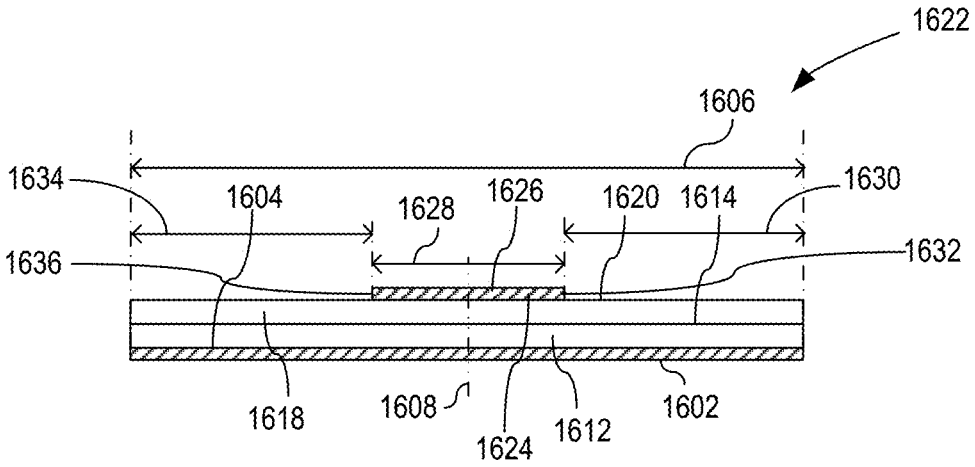
FIG. 16D is a cross-sectional view of a third combination of the second combination with a printed second conductive layer in accordance with the present disclosure.

In FIG. 16D, a cross-sectional view of a third combination 1622 of the second combination 1616 with a printed second conductive layer 1624 is shown in accordance with the present disclosure. Specifically, the printed second conductive layer 1624 has a top surface 1626 and a second width 1628 (that is less than the first width 1606) that is printed on the top surface 1620 of the second dielectric layer 1618. The printed second conductive layer 1624 is the inner conductor 106. In this example, the second width 1628 results in a first gap 1630 at a first end 1632 of the second conductive layer 1624 and a second gap 1634 at a second end 1636 of the second conductive layer 1624, where the top surface 1620 of the second dielectric layer 1618 is exposed.

Figure 16E:
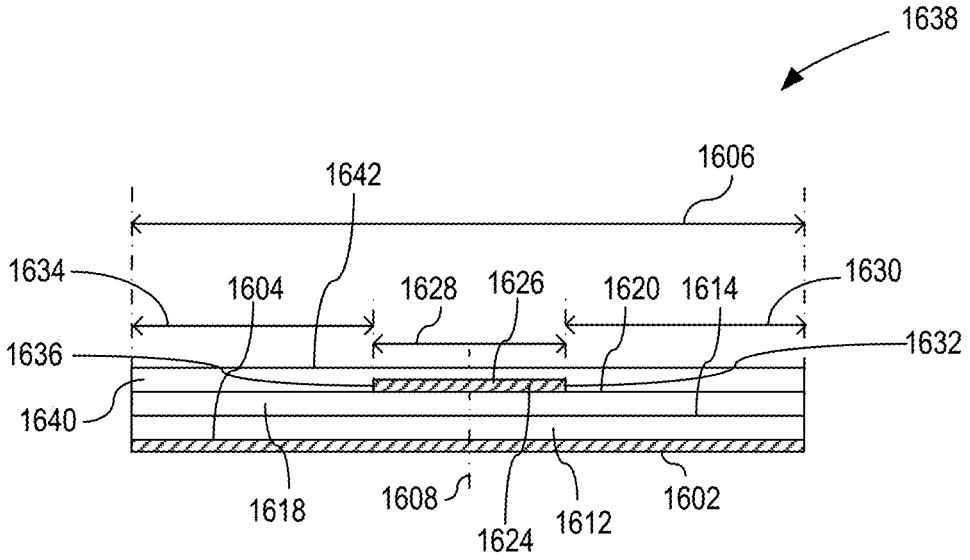
FIG. 16E is a cross-sectional view of a fourth combination of the third combination with a printed third dielectric layer in accordance with the present disclosure.

In FIG. 16E, a cross-sectional view of a fourth combination 1638 of the third combination 1622 with a printed third dielectric layer 1640 is shown in accordance with the present disclosure. Specifically, the printed third dielectric layer 1640 is printed on the top surface 1626 of the printed second conductive layer 1624 and the top surface 1620 of the printed second dielectric layer 1618 though the first gap 1630 and second gap 1634. In this example, the printed third dielectric layer 1640 has a top surface 1642. Furthermore, in this example, the printed third dielectric layer 1640 may have a height that is greater than or equal to the height of the printed second conductive layer 1624.

Figure 16F:
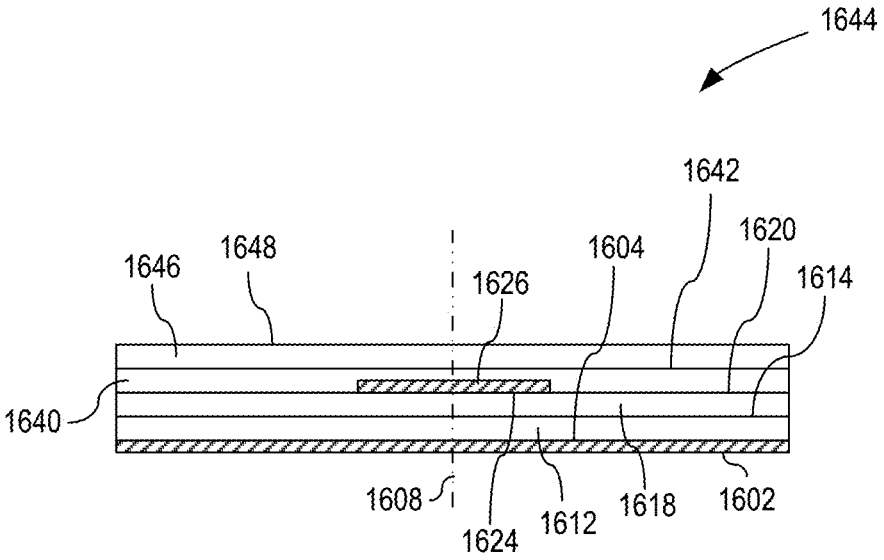
FIG. 16F is a cross-sectional view of a fifth combination in accordance with the present disclosure.

In FIG. 16F, a cross-sectional view of a fifth combination 1644 is shown in accordance with the present disclosure. The fifth combination 1644 is a combination of the fourth combination 1638 and a printed fourth dielectric layer 1646. Specifically, the printed fourth dielectric layer 1646 has a top surface 1648 and is printed on the top surface 1642 of the printed third dielectric layer 1640. It is appreciated by those of ordinary skill in the art that based on the design and thickness of the third dielectric layer 1940, the fourth dielectric layer 1646 may be optional. Specifically, the distance between the printed second conductive layer 1624 and a soon to be printed third conductive layer (not shown) is a predetermined distance based on the design of the ACMWT. As such, the height of the third dielectric layer 1640 is either equal to this predetermined distance if the fourth dielectric layer 1646 is not utilized or the height of the combination of the third dielectric layer 1640 and the fourth dielectric layer 1646 is equal to the predetermined distance.

Figure 16G:
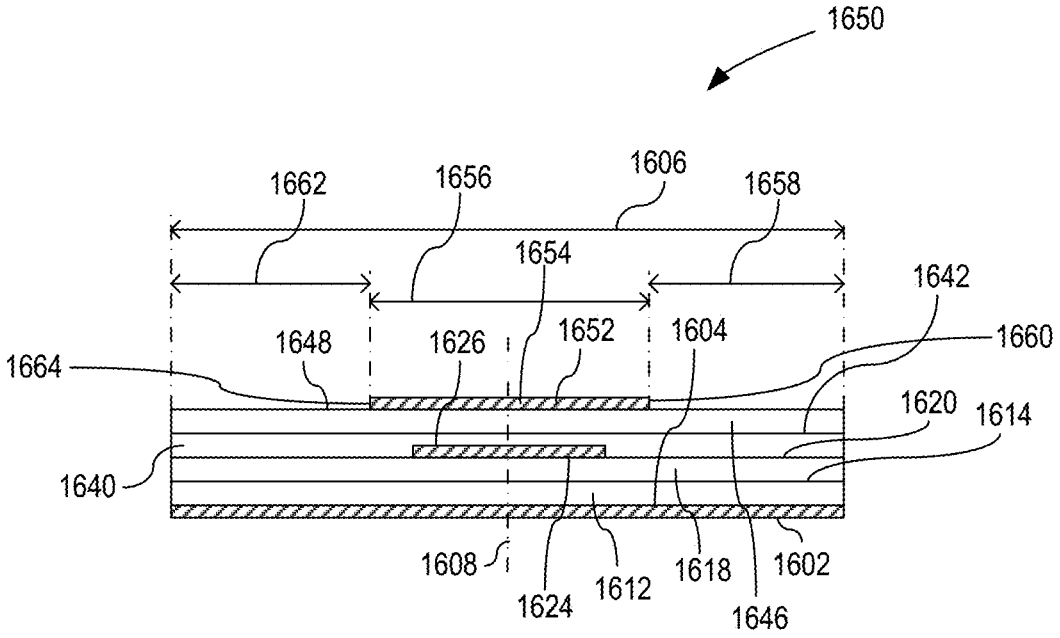
FIG. 16G is a cross-sectional view of a sixth combination in accordance with the present disclosure.

In FIG. 16G, a cross-sectional view of a sixth combination 1650 is shown in accordance with the present disclosure. The sixth combination 1650 is a combination of the fifth combination 1644 and a printed third conductive layer 1652. The printed third conductive layer 1652 has a top surface 1654 and a third width 1656 (that is less than the first width 1606) that is printed on the top surface 1648 of the printed fourth dielectric layer 1646. In this example, the third width 1656 results in a first gap 1658 at a first end 1660 of the printed third conductive layer 1652 and a second gap 1662 at a second end 1664 of the printed third conductive layer 1652, where the top surface 1648 of the printed fourth dielectric layer 1646 is exposed. The third conductive layer 1652 is a CE (e.g., CE 502).

Figure 16H:
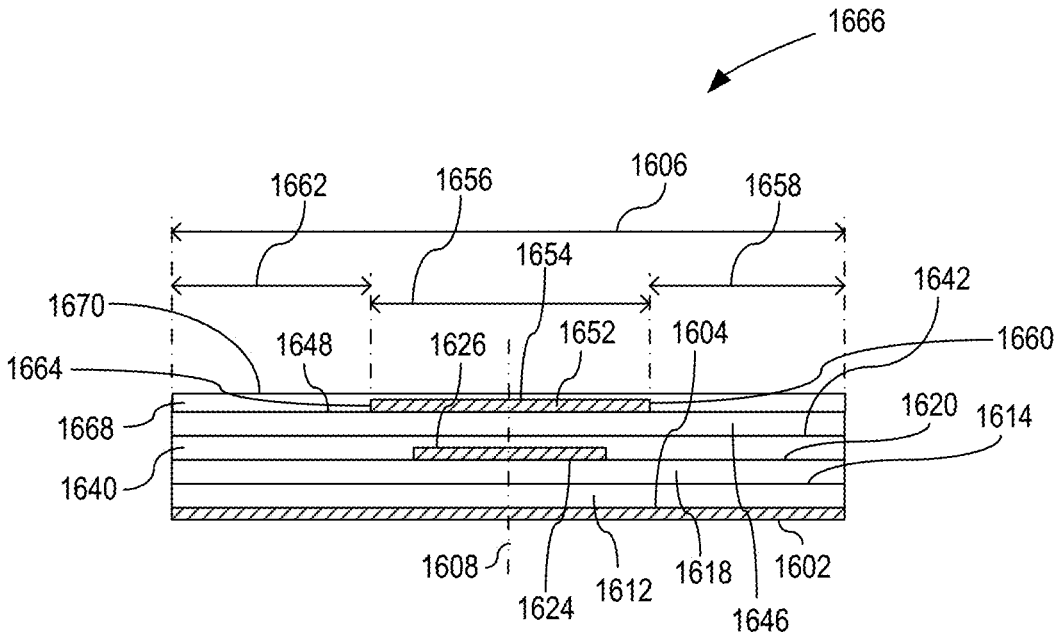
FIG. 16H is a cross-sectional view of a seventh combination of the sixth combination with a printed fifth dielectric layer in accordance with the present disclosure.

In FIG. 16H, a cross-sectional view of a seventh combination 1666 of the sixth combination 1650 with a printed fifth dielectric layer 1668 is shown in accordance with the present disclosure. Specifically, the printed fifth dielectric layer 1668 is printed on the top surface 1654 of the printed third conductive layer 1652 and the top surface 1648 of the printed fourth dielectric layer 1646 though the first gap 1658 and second gap 1662. In this example, the printed fifth dielectric layer 1668 has a top surface 1670. Furthermore, in this example, the printed fifth dielectric layer 1668 may have a height that is greater than or equal to the height of the printed third conductive layer 1652.

Figure 16I:
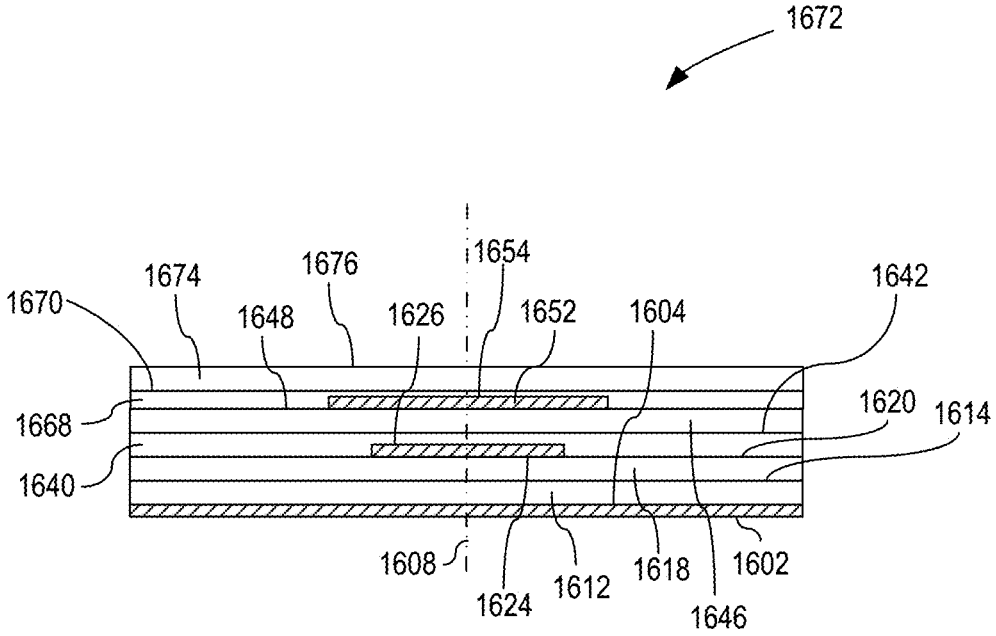
FIG. 16I is a cross-sectional view of an eighth combination of the seventh combination with a printed sixth dielectric layer in accordance with the present disclosure.

In FIG. 16I, a cross-sectional view of an eighth combination 1672 of the seventh combination 1666 with a printed sixth dielectric layer 1674 is shown in accordance with the present disclosure. The printed sixth dielectric layer 1674 has a top surface 1676 and is printed on the top surface 1670 of the printed fifth dielectric layer 1668. It is appreciated by those of ordinary skill in the art that based on the design and thickness of the fifth dielectric layer 1668, the sixth dielectric layer 1674 may be optional. Specifically, the distance between the printed third conductive layer 1652 and a soon to be printed fourth conductive layer (not shown) is a predetermined distance based on the design of the ACMWT. As such, the height of the fifth dielectric layer 1668 is either equal to this predetermined distance if the sixth dielectric layer 1674 is not utilized or the height of the combination of the fifth dielectric layer 1668 and the sixth dielectric layer 1674 is equal to the predetermined distance.

Figure 16J:
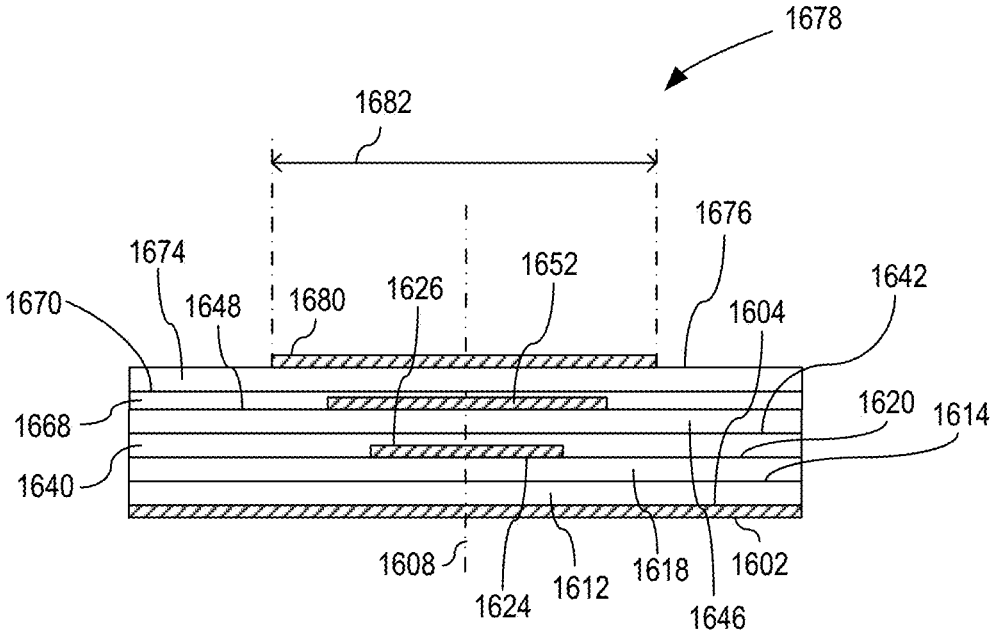
FIG. 16J is a cross-sectional view of a composite printed structure of the seventh combination with a printed fourth conductive layer in accordance with the present disclosure.

In FIG. 16J, a cross-sectional view of a composite printed structure 1678 of the eighth combination 1672 with a printed fourth conductive layer 1680 is shown in accordance with the present disclosure. The printed fourth conductive layer 1680 is printed on a portion of the top surface 1676 of the printed sixth dielectric layer 1674 and has a fourth width 1682 (that is less than the first width 1606). The printed fourth conductive layer 1680 is the PAE 200 with the antenna slot 204 and the composite printed structure 1678 is the dielectric structure (e.g., dielectric structure 104).

Figure 16K:
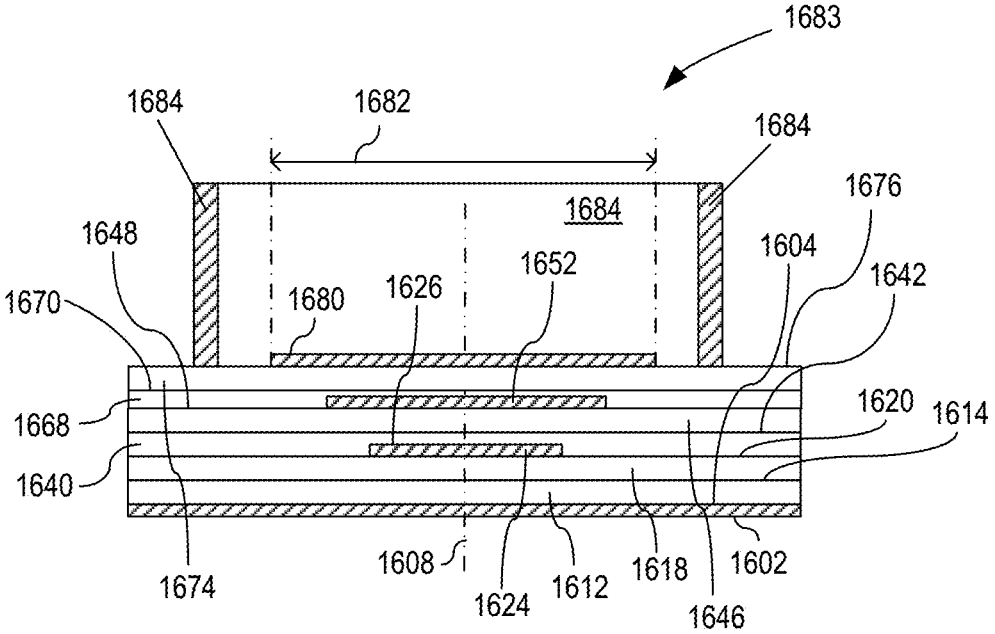
FIG. 16K is a cross-sectional view of a combined printed structure of the ACMWT in accordance with the present disclosure.

In FIG. 16K, a cross-sectional view of a combined printed structure 1683 of the ACMWT is shown in accordance with the present disclosure. In this view, the waveguide walls 1684 (e.g., waveguide walls 116 or waveguide wall 304) are attached to the composite printed structure 1678 on the top surface 1676 of the printed sixth dielectric layer 1674.

In this example, as described in relation to FIG. 6, the ACMWT may include an optional cavity (that may be filled with air) about the printed second conductive layer 1624 (i.e., the inner conductor 106). This optional cavity may be formed within the printed third dielectric layer 1640. In this example, the printed third dielectric layer 1640 may include sub-sections of the printed third dielectric layer 1640 to produce at least one cavity that may be about (i.e., surround) the printed second conductive layer 1624.

As discussed earlier, the ACMWT may also include printing (or attaching by other means) a rigid surface layer (not shown) on the top surface 1676 of the printed sixth dielectric layer 1674 so as to establish a rigid base for the waveguide walls 1684. The thickness of this rigid surface layer may vary based on the design of the ACMWT such as a smaller thickness as shown in FIGS. 8A and 8B to a thickness that is approximately equal to the waveguide length 904 as shown in FIGS. 9A through 9C.

Figure 17:
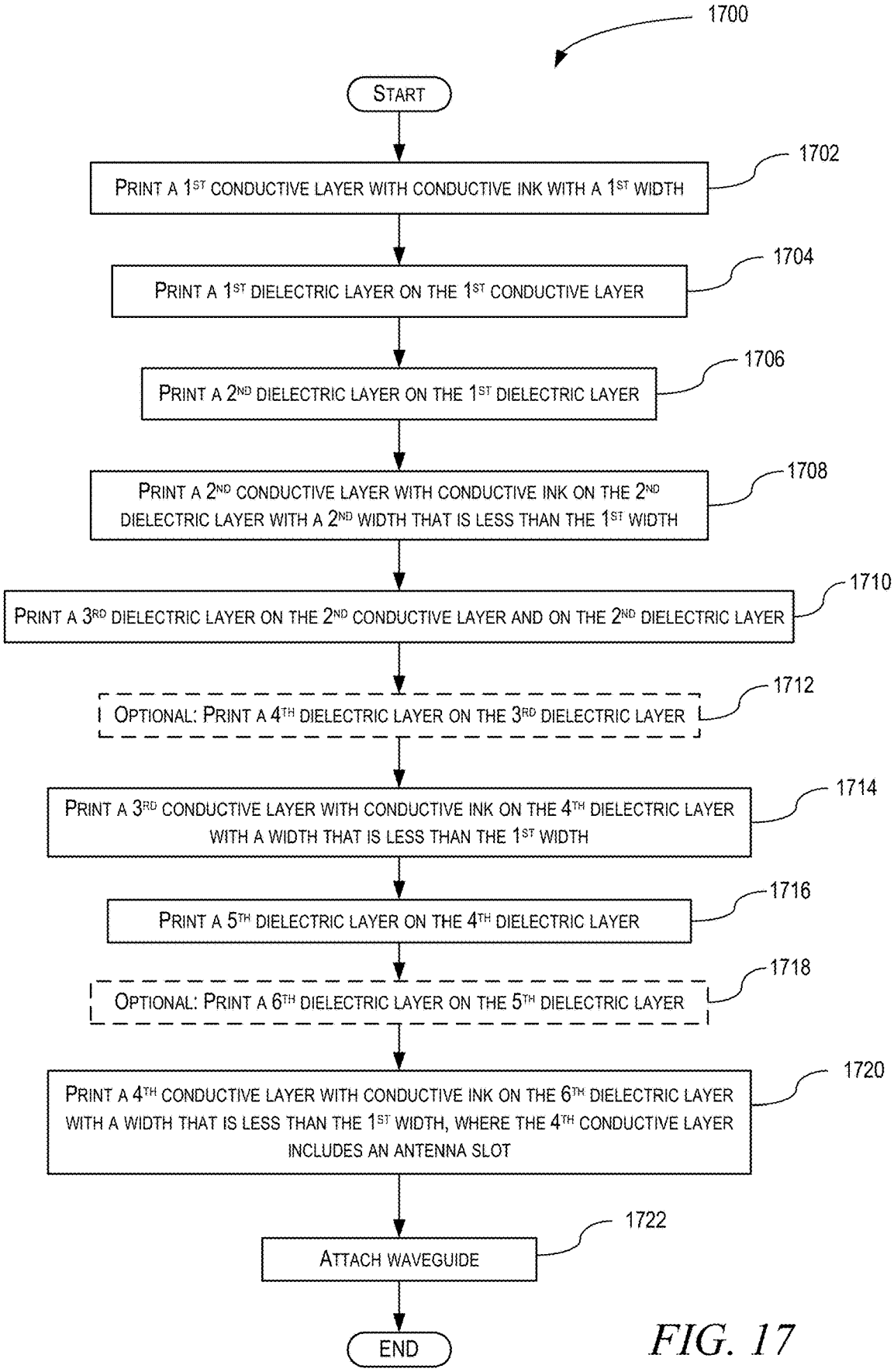
FIG. 17 is a flowchart of an example implementation of a method for fabricating the ACMWT utilizing a three-dimensional ("3-D") additive printing process in accordance with the present disclosure.

In FIG. 17, a flowchart is shown of an example implementation of method 1700 for fabricating the ACMWT (i.e., ACMWT 100, 300, 500, 600, 800, and 900) utilizing a 3-D additive printing process in accordance with the present disclosure. The method 1700 is related to the method for fabricating the ACMWT utilizing the additive 3-D printing process as shown in FIGS. 16A-16K.

The method 1700 starts by printing 1702 the first conductive layer 1602. The first conductive layer 1602 includes a top surface 1604 and has a first width 1606 with a first center 1608. The first conductive layer 1602 is the bottom conductor 112 configured as a reference ground plane. The method 1700 then includes printing 1704 the first dielectric layer 1612 on the top surface 1604 of the first conductive layer 1602. The first dielectric layer 1612 includes a top surface 1614. The method 1700 then includes printing 1706 the second dielectric layer 1618 (with a top surface 1620) on the top surface 1614 of the first dielectric layer 1612. The method 1700 then includes printing 1708 the second conductive layer 1624 on the top surface 1620 of the second dielectric layer 1618. The second conductive layer 1624 has a top surface 1626 and a second width 1628, where the second width 1628 is less than the first width 1606. Moreover, the second conductive layer 1624 is the inner conductor (e.g., inner conductor 106). The method 1700 further includes printing 1710 the third dielectric layer 1640 (with a top surface 1642) on the top surface 1626 of the second conductive layer 1624 and on the top surface 1620 on of the second dielectric layer 1618. The third dielectric layer 1640 has a top surface 1642. The method 1700 then includes optionally printing 1712 the fourth dielectric layer 1646 (with a top surface 1648) on the top surface 1642 of the third dielectric layer 1640. As discussed earlier in relation to FIGS. 16A to 16K, it is appreciated by those of ordinary skill in the art that based on the design and thickness of the third dielectric layer 1640, the fourth dielectric layer 1646 is optional. The distance between the printed second conductive layer 1624 and the printed third conductive layer 1652 is a predetermined distance based on the design of the ACMWT. As such, the height of the third dielectric layer 1640 is either equal to this predetermined distance (if the fourth dielectric layer 1646 is not utilized) or the height of the combination of the third dielectric layer 1640 and the fourth dielectric layer 1646 is equal to the predetermined distance.

Moreover, the method 1700 includes printing 1714 the third conductive layer 1652 on the top surface 1648 of the fourth dielectric layer 1646 if the fourth dielectric layer 1646 is present or on the top surface 1642 of the third dielectric layer 1640 if the fourth dielectric layer 1646 is not present. For purposes of ease of illustration, for this example, it will be assumed that the fourth dielectric layer 1646 is present; however, it is appreciated that the following description may be modified accordingly if the fourth dielectric layer 1646 is not present.

The third conductive layer 1652 has a top surface 1654 and a third width 1656, where the third width 1656 is less than the first width 1606. The third conductive layer 1652 is a CE (e.g., CE 502). The method 1700 then includes printing 1716 a fifth dielectric layer 1668 on the top surface 1648 of the fourth dielectric layer 1646 and optionally printing on the top surface 1654 of the third conductive layer 1652. The fifth dielectric layer 1668 has a top surface 1670. The method then includes optionally printing 1718 a sixth dielectric layer 1674 on the top surface 1670 of the fifth dielectric layer 1668, where the sixth dielectric layer 1674 has a top surface 1676.

As discussed earlier in relation to FIGS. 16A to 16K, it is again appreciated by those of ordinary skill in the art that based on the design and thickness of the fifth dielectric layer 1668, the sixth dielectric layer 1674 is optional. Specifically, in addition to the distance between the printed second conductive layer 1624 and the printed third conductive layer 1652 being a predetermined distance based on the design of the ACMWT, the distance between the printed third conductive layer 1652 and the printed fourth conductive layer 1680 is also a second predetermined distance based on the design of the ACMWT. As such, the height of the fifth dielectric layer 1668 is either equal to the second predetermined distance if the sixth dielectric layer 1674 is not utilized or the height of the combination of the fifth dielectric layer 1668 and the sixth dielectric layer 1674 is equal to the second predetermined distance. Again, for purposes of ease of illustration, for this example, it will be assumed that the sixth dielectric layer 1674 is present; however, it is appreciated that the following description may be modified accordingly if the sixth dielectric layer 1674 is not present.

The method then includes printing 1720 the fourth conductive layer 1680 on the top surface 1676 of the sixth dielectric layer 1674 to produce a PAE (e.g., PAE 200) with an antenna slot (e.g. antenna slot 204). The fourth conductive layer 1680 has a fourth width 1682, where the fourth width 1682 is less than the first width 1606. The fourth conductive layer 1680 includes an antenna slot within the fourth conductive layer 1980 that exposes the top surface 1676 of the sixth dielectric layer 1674 through the fourth conductive layer 1680.

The method 1700 then further includes attaching 1722 the waveguide to the top surface 1676 of the sixth dielectric layer 1674. The method 1700 then ends.

In this example, the method 1700 may utilize a submethod where one or more of the first conductive layer 1602, second conductive layer 1624, third conductive layer 1652, and fourth conductive layer 1680 are formed by a subtractive method (e.g., wet etching, milling, or laser ablation) of electroplated or rolled metals or by an additive method (e.g., printing or deposition) of printed inks or deposited thin-films.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. An aperture coupled microstrip-to-waveguide transition, comprising:

a plurality of dielectric layers forming a dielectric structure, wherein a top dielectric layer from the plurality of dielectric layers includes a top surface;

an inner conductor formed within the dielectric structure;

a patch antenna element formed on the top surface;

a coupling element formed within the dielectric structure;

a bottom conductor;

an antenna slot within the patch antenna element; and a waveguide comprising at least one waveguide wall and a waveguide backend, wherein the waveguide backend has a waveguide backend surface that is a portion of the top surface of the top dielectric layer, wherein the waveguide backend surface and the at least one waveguide wall form a waveguide cavity within the waveguide, wherein the patch antenna element is located within the waveguide cavity at the waveguide backend surface, wherein the patch antenna element is a conductor, wherein the dielectric structure is configured to support a transverse electromagnetic signal during use, and wherein the waveguide is configured to support a transverse electric signal and a transverse magnetic signal during the use.

2. The aperture coupled microstrip-to-waveguide transition of claim 1, wherein the antenna slot is angled along the patch antenna element with respect to the inner conductor.

3. The aperture coupled microstrip-to-waveguide transition of claim 1, wherein each dielectric layer from the plurality of dielectric layers comprises a dielectric laminate material.

4. The aperture coupled microstrip-to-waveguide transition of claim 1, wherein the dielectric structure comprises a stack-up height and a dielectric structure width, wherein the inner conductor is located in a middle dielectric layer within the dielectric structure, wherein the middle dielectric layer is approximately at a center position equal to approximately half of the stack-up height, and wherein the inner conductor comprises an inner conductor center located within the dielectric structure, the inner conductor center approximately at a second center position equal to approximately half of the dielectric structure width.

5. The aperture coupled microstrip-to-waveguide transition of claim 1, wherein each dielectric layer from the plurality of dielectric layers comprises a dielectric laminate material, and wherein the inner conductor is a stripline or microstrip conductor.

6. The aperture coupled microstrip-to-waveguide transition of claim 1, wherein the coupling element is formed within the dielectric structure above the inner conductor and below the patch antenna element.

7. The aperture coupled microstrip-to-waveguide transition of claim 6, wherein the inner conductor comprises an inner conductor length and an inner conductor width that are predetermined to approximately optimize electromagnetic coupling between the transverse electromagnetic signal on the inner conductor and the transverse electric signal or the transverse magnetic signal in the waveguide at a predetermined operating frequency.

8. The aperture coupled microstrip-to-waveguide transition of claim 7, wherein the coupling element is a stub, wherein the coupling element comprises a coupling element length, a coupling element width, and is at an angle with respect to the inner conductor, and wherein the coupling element length, the coupling element width, and the angle are predetermined to approximately optimize electromagnetic coupling between the transverse electromagnetic signal on the inner conductor and the transverse electric signal or the transverse magnetic signal in the waveguide at a predetermined operating frequency.

9. The aperture coupled microstrip-to-waveguide transition of claim 8, wherein the patch antenna element is circular and the antenna slot is rectangular, wherein the patch antenna element comprises a radius, wherein the antenna slot has a slot length, a slot width, and is at an angle with respect to the inner conductor, and wherein the radius of the patch antenna element, the slot length, the slot width, and the angle are predetermined to optimize electromagnetic coupling between the transverse electromagnetic signal on the inner conductor and the transverse electric signal or the transverse magnetic signal in the waveguide at a predetermined operating frequency.

10. The aperture coupled microstrip-to-waveguide transition of claim 1, further including a cavity formed within the dielectric structure above the inner conductor and below the patch antenna element.

11. The aperture coupled microstrip-to-waveguide transition of claim 10, wherein the coupling element is formed within the dielectric structure above the cavity and below the patch antenna element.

12. The aperture coupled microstrip-to-waveguide transition of claim 10, wherein the cavity is filled with air, and wherein the inner conductor includes a portion located within the cavity.

13. A method for fabricating an aperture coupled microstrip-to-waveguide transition utilizing a lamination process, the method comprising:

patterning a first conductive layer on a bottom surface of a first dielectric layer to produce a bottom conductor, wherein the first dielectric layer includes a top surface;

patterning a second conductive layer on a top surface of a second dielectric layer to produce an inner conductor, wherein the second dielectric layer includes a bottom surface;

laminating the bottom surface of the second dielectric layer to the top surface of the first dielectric layer to produce a first combination;

patterning a third conductive layer on a top surface of a third dielectric layer to produce a patch antenna element with an antenna slot, wherein the third dielectric layer includes a bottom surface;

patterning a fourth conductive layer on a top surface of a fourth dielectric layer to produce a coupling element, wherein the fourth dielectric layer includes a bottom surface;

laminating the bottom surface of the fourth dielectric layer to the top surface of the second dielectric layer to produce a second combination;

laminating the bottom surface of the third dielectric layer to the top surface of the fourth dielectric layer to produce a composite laminated structure, wherein the composite laminated structure is a dielectric structure; and attaching a waveguide wall to the composite laminated structure.

14. The method of claim 13, wherein the fourth dielectric layer includes sub-sections of the fourth dielectric layer to produce at least one cavity, and wherein laminating the bottom surface of the fourth dielectric layer to the top surface of the second dielectric layer to produce the second combination includes forming the at least one cavity about the second conductive layer.

15. The method of claim 14, wherein the first conductive layer, the second conductive layer, the third conductive layer, and the fourth conductive layer are conductive metals.

16. The method of claim 15, wherein at least one of the first conductive layer, the second conductive layer, the third conductive layer, and the fourth conductive layer is formed by a subtractive method of electroplated or rolled metals or is formed by an additive method of printed inks or deposited thin-films, and wherein the subtractive method includes wet etching, milling, or laser ablation.

17. The method of claim 13, further comprising laminating a rigid surface layer on the composite laminated structure.

18. A method for fabricating an aperture coupled microstrip-to-waveguide transition utilizing a three-dimensional additive printing process, the method comprising:

printing a first conductive layer having a top surface and a first width, wherein the first width has a first center and wherein the first conductive layer is a bottom layer configured as a reference ground plane;

printing a first dielectric layer on the top surface of the first conductive layer, wherein the first dielectric layer has a top surface;

printing a second dielectric layer on the top surface of the first dielectric layer, wherein the second dielectric layer has a top surface;

printing a second conductive layer on the top surface of the second dielectric layer, wherein the second conductive layer has a top surface and a second width, wherein the second width is less than the first width, and wherein the second conductive layer is an inner conductor;

printing a third dielectric layer on the top surface of the second conductive layer and on the top surface on the second dielectric layer, wherein the third dielectric layer has a top surface;

printing a third conductive layer on the top surface of the third dielectric layer, wherein the third conductive layer has a top surface and a third width, wherein the third width is less than the first width, and wherein the third conductive layer is a coupling element;

printing a fourth dielectric layer on the top surface of the third conductive layer and on the top surface of the third dielectric layer, wherein the fourth dielectric layer has a top surface; and printing a fourth conductive layer on the top surface of the fourth dielectric layer to produce a patch antenna element with an antenna slot, wherein the fourth conductive layer has a fourth width, wherein the fourth width is less than the first width, and wherein the fourth conductive layer includes the antenna slot within the fourth conductive layer that exposes the top surface of the fourth dielectric layer through the fourth conductive layer; and attaching a waveguide wall to the fourth dielectric layer.

19. The method of claim 18, wherein the third dielectric layer includes sub-sections to produce at least one cavity.

20. The method of claim 18, further comprising:

printing a fifth dielectric layer on the top surface of the third dielectric layer, wherein the fifth dielectric layer has a top surface, and printing a sixth dielectric layer on the top surface of the fourth dielectric layer, wherein the sixth dielectric layer has a top surface, wherein printing the third conductive layer on the top surface of the third dielectric layer includes printing the third conductive layer on the top surface of the fifth dielectric layer, and wherein printing the fourth conductive layer on the top surface of the fourth dielectric layer to produce the patch antenna element includes printing the sixth dielectric layer on the top surface of the fourth dielectric layer and printing the fourth conductive layer on the top surface of the sixth dielectric layer.

* * * * *